US010633858B2

(12) United States Patent
Stahl, Jr. et al.

(10) Patent No.: US 10,633,858 B2
(45) Date of Patent: Apr. 28, 2020

(54) PREFABRICATED CURTAIN WALL ASSEMBLY

(71) Applicant: Specified Technologies Inc., Somerville, NJ (US)

(72) Inventors: James P. Stahl, Jr., Princeton, NJ (US); Paul Gandolfo, Doylestown, PA (US); Julio Lopes, Dunellen, NJ (US)

(73) Assignee: Specified Technologies Inc., Somerville, NJ (US)

( * ) Notice: Subject to any disclaimer, the term of this patent is extended or adjusted under 35 U.S.C. 154(b) by 0 days.

(21) Appl. No.: 16/448,289

(22) Filed: Jun. 21, 2019

(65) Prior Publication Data

US 2019/0309514 A1 Oct. 10, 2019

Related U.S. Application Data

(63) Continuation-in-part of application No. 16/176,093, filed on Oct. 31, 2018, which is a continuation-in-part
(Continued)

(51) Int. Cl.
*E04B 2/96* (2006.01)
*E04B 1/76* (2006.01)
(Continued)

(52) U.S. Cl.
CPC ..... *E04B 2/965* (2013.01); *E04B 1/40* (2013.01); *E04B 1/7629* (2013.01); *E04B 2001/405* (2013.01)

(58) Field of Classification Search
CPC ..... E04B 1/40; E04B 2/88; E04B 2001/405; E04B 2/96; E04B 1/2403; E04B 2/825; E04B 2001/2415
See application file for complete search history.

(56) References Cited

U.S. PATENT DOCUMENTS

D242,766 S 12/1976 Neece
4,207,717 A 6/1980 Hubbard
(Continued)

FOREIGN PATENT DOCUMENTS

EP 0586320 A1 3/1994
KR 100996902 B1 11/2010
(Continued)

OTHER PUBLICATIONS

"Halfen HCW Curtain Wall Technical Product Information," Halfen, halfen.com, HCW-14.1 US, Oct. 2014.

*Primary Examiner* — Brian D Mattei
(74) *Attorney, Agent, or Firm* — Fox Rothschild LLP; Robert J. Sacco

(57) ABSTRACT

Assembling a multi-story building using a prefabricating a curtain wall assembly (CWA) involves assembling a structural frame and preparing the frame to receive a thermal insulation panel in a spandrel area. A thermal insulation panel is then supported in the spandrel area using a flange plate of a plurality of brackets that are secured to the frame. The thermal insulation panel is engaged or secured using one or more clips which retain the panel to the frame. The process continues by attaching the CWA which has been prefabricated to a floor slab on the building to form a portion of the building curtain wall.

20 Claims, 29 Drawing Sheets

Related U.S. Application Data of application No. 15/818,271, filed on Nov. 20, 2017, now Pat. No. 10,329,761, which is a continuation-in-part of application No. 15/874,663, filed on Jan. 18, 2018, now Pat. No. 10,329,762.

(60) Provisional application No. 62/424,772, filed on Nov. 21, 2016.

(51) Int. Cl.
*E04B 1/41* (2006.01)
*E04B 1/38* (2006.01)

(56) References Cited

U.S. PATENT DOCUMENTS

D294,914 S 3/1988 Chase et al.
4,912,898 A 4/1990 Holmes
4,918,879 A 4/1990 Bodurow et al.
5,325,651 A * 7/1994 Meyer ..... E04B 2/766 52/243
5,381,637 A 1/1995 Farag
5,555,689 A 9/1996 Gilmore
6,213,679 B1 4/2001 Frobosilo et al.
6,430,885 B1 8/2002 Ito
6,591,562 B2 7/2003 Ting
6,612,090 B1 9/2003 Corden
6,739,105 B2 5/2004 Fleming
6,951,087 B2 10/2005 Weurman
6,993,875 B2 2/2006 Rudduck
7,162,842 B2 1/2007 Ribic
7,854,099 B2 12/2010 Kidd
7,886,491 B1 2/2011 Shriver
8,033,066 B2 10/2011 Griffiths
8,443,556 B2 5/2013 Hiscock et al.
8,615,938 B2 12/2013 Arbour
9,016,014 B2 4/2015 Shriver
D767,973 S 10/2016 DeDios-Shirley et al.
9,683,367 B1 6/2017 Ting
10,364,566 B1 * 7/2019 LeBlang ..... E04B 2/74
2002/0124514 A1 9/2002 Higgins
2003/0033765 A1 2/2003 Ting
2005/0056749 A1 3/2005 Simard
2005/0066613 A1 3/2005 Bourque
2006/0006296 A1 1/2006 Morita
2008/0229680 A1 * 9/2008 Jahn ..... E04B 9/067 52/105
2010/0107532 A1 5/2010 Shriver
2012/0247059 A1 * 10/2012 Daudet ..... E04B 1/2403 52/705
2014/0059973 A1 3/2014 Duranleau
2016/0237682 A1 8/2016 Stronks et al.
2017/0204600 A1 7/2017 Daudet et al.
2017/0342724 A1 11/2017 Farahmandpour
2018/0094423 A1 4/2018 Getz
2018/0142463 A1 5/2018 Siddhartha et al.
2018/0245352 A1 8/2018 Duranleau

FOREIGN PATENT DOCUMENTS

KR 101672855 B1 11/2016
KR 20170017390 A 2/2017
RU 170635 U1 5/2017

* cited by examiner

PREFABRICATED CURTAIN WALL ASSEMBLY

RELATED APPLICATION

This patent document is a continuation-in-part of U.S. patent application Ser. No. 16/176,093 (the '093 application) filed Oct. 31, 2018, which is a continuation-in-part of U.S. patent application Ser. No. 15/818,271 (the '271 application) filed on Nov. 20, 2017 and U.S. patent application Ser. No. 15/874,663 (the '663 application) filed on Jan. 18, 2018. The '271 application also claims priority to U.S. Provisional Patent Application No. 62/424,772 (the '772 application) filed Nov. 21, 2016. The disclosures of the '093, the '271, the '663 and '772 applications are incorporated herein by reference in full.

FIELD OF THE INVENTION

The present invention relates to a curtain wall insulation system, and in particular to a bracket and clip system for retaining wall insulation within the spandrel area of a curtain wall.

BACKGROUND OF THE INVENTION

Modern, multiple story buildings may be formed with an external wall structure that is secured to a floor slab. The external wall structure, or curtain wall, is secured to the slab, which is made of concrete, and the curtain wall is at a distance spaced away from the slab. By creating a gap between the slab and the curtain wall, proper alignment of the curtain wall is ensured. For example, in the event that the slab for a particular floor is not entirely straight or the slabs of adjacent floors are not properly aligned, the size of the gap between the curtain wall and a slab may be adjusted at various points along the slab to align the curtain wall so that it is substantially straight along the entire length and/or height of the building.

While the gap created between the curtain wall and the slabs of a building may be necessary to allow for proper alignment of the curtain wall, in the event of a fire, smoke, hot gasses, and/or flames, any of these conditions could pass from one floor to another through the gap between the curtain wall and the slabs. In order to prevent smoke, hot gasses, and/or fire from passing freely through this gap, safing insulation may be positioned between the slabs and spandrels of the curtain wall. Specifically, the spandrel areas of the curtain wall may be backed by a layer of spandrel insulation and the safing may be positioned between the spandrel insulation and the slabs in order to fill the gap between the spandrels and the slabs.

While systems of installing the spandrel insulation are known, such systems are often labor intensive, requiring screws, other additional fasteners, and/or are dangerous, requiring sharp pins or impaling spikes. For example, U.S. Pat. No. 7,886,491 to Shriver discloses an "Impasse" system used in today's curtain wall system using insulation hangers, which are steel base clips with a 12 GA steel pin swaged to the center. Such system requires screws to attach hangers and the insulation to be impaled onto the sharpened end, which is not always so easy to do in the field and may actually pose a safety risk to workers.

Still, most other systems require multiple screws and attachment points to be anywhere from 8 to 12 inches O.C. As the cost for installing each screw may be as high as $1.00 for the extra time and material it takes, the cost for installing these systems may add up quickly. Further, sometimes mullions also serve to allow for drainage, so driving screws in can create points that could later leak. Other times, mullions may incorporate some steel into the aluminum for strength, and pilot holes need to be drilled in there. Thus, it is desirable to reduce or eliminate screws in the installation of curtain wall insulation system.

This disclosure describes systems that address at least some of the technical issues discussed above, and/or other issues.

SUMMARY

The solution concerns a method for prefabricating a curtain wall assembly (CWA) for a building. The method begins with assembling a frame. This involves aligning in parallel a pair of mullion members which are spaced apart a first predetermined distance in a common plane. A plurality of transom members are then secured to the mullion members. The transom members extend orthogonal to the mullion members and span the predetermined distance to form a rigid rectangular construct having a frame thickness. This frame thickness is defined by a frame wall which extends orthogonal to the common plane from an interior frame edge to an exterior frame edge;

The process continues by preparing the frame for receiving insulation in a spandrel area. The spandrel area is defined as an interior area of the frame which extends between the pair of mullions. The area is further defined by a plurality of transoms. The frame is prepared for the insulation by mounting one or more brackets along the interior frame edge at spaced apart locations on opposing inner faces of the frame wall as defined by the pair of mullion members. Thereafter, a thermal insulation panel is supported in the spandrel area using a flange plate of each bracket. This flange plate is formed form a first major side of each bracket which extends into the spandrel area from the opposing inner faces. The thermal insulation panel in the spandrel area is then engaged using one or more clips. The clips are retained to the frame by inserting a first clip leg of each clip in a receiver aperture which is provided on a side plate of each bracket, where the side plate defines a second major side of the bracket extending transverse to the first side.

The solution also concerns a method for assembling a multi-story building using a prefabricating a curtain wall assembly (CWA). The method involves assembling a frame as and preparing it to receive a thermal insulation panel in a spandrel area as described above. The process continues by supporting the thermal insulation panel in the spandrel area using a flange plate of each bracket, as described and engaging the thermal insulation panel in the spandrel area using one or more clips. These clips are retained to the frame by inserting a first clip leg of each clip in a receiver aperture which is provided on a side plate of each bracket as described above. Thereafter, the process continues by securing the CWA which has been prefabricated to a floor slab on the building to form a portion of the building curtain wall after the thermal insulation panel has been installed.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of various embodiments. In the drawings.

DETAILED DESCRIPTION OF THE INVENTION

Figure 1:
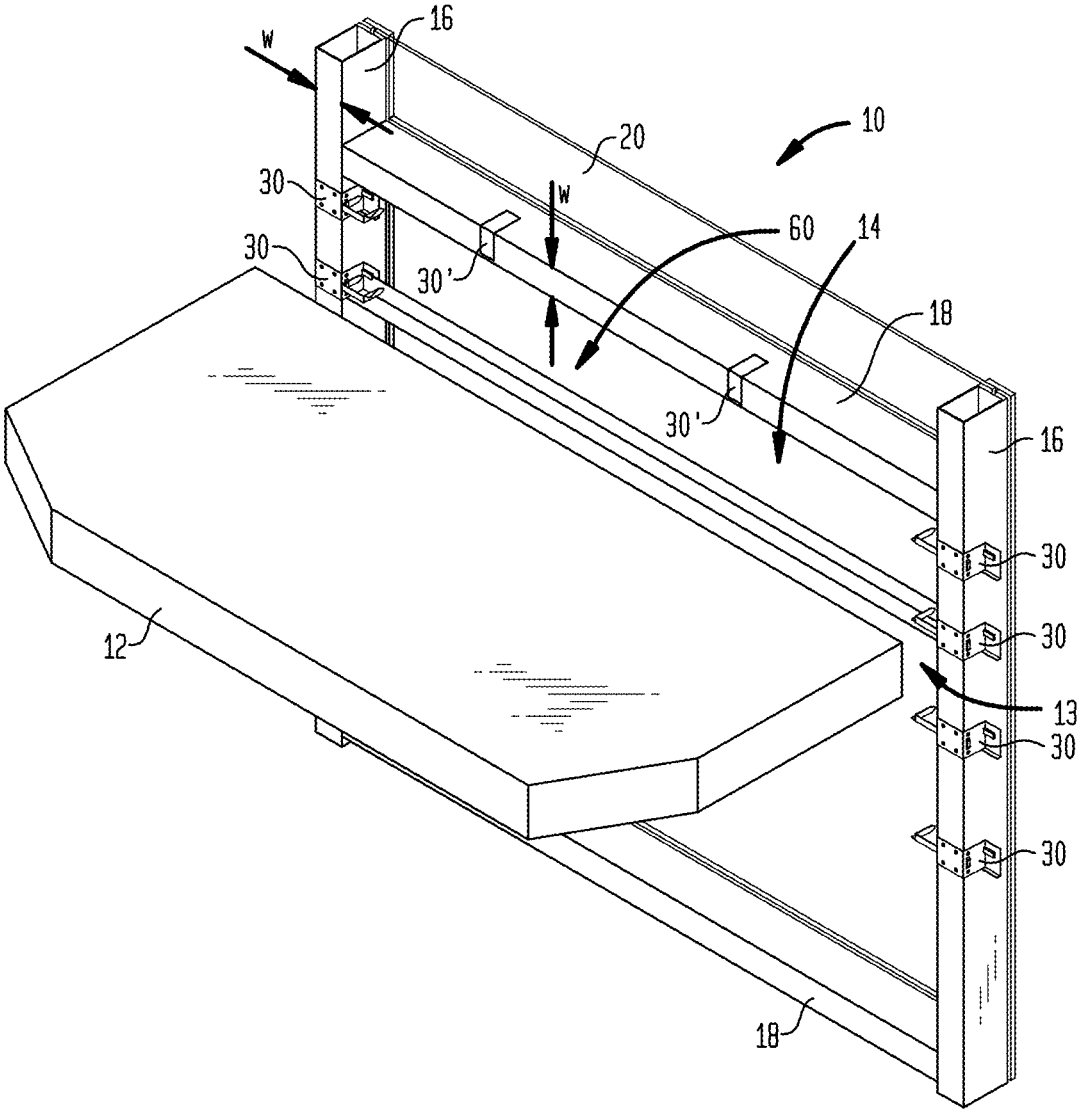
FIG. 1 is an isometric view of a wall system with mullions and transoms defining a spandrel area and brackets in accordance with some embodiments positioned on the mullions and transoms. The spandrel insulation is omitted from the figure for clarity.

In the drawings, like numerals indicate like elements throughout. Certain terminology is used herein for convenience only and is not to be taken as a limitation on the present invention. The following describes preferred embodiments of the present invention. However, it should be understood, based on this disclosure, that the invention is not limited by the preferred embodiments described herein.

Figure 2:
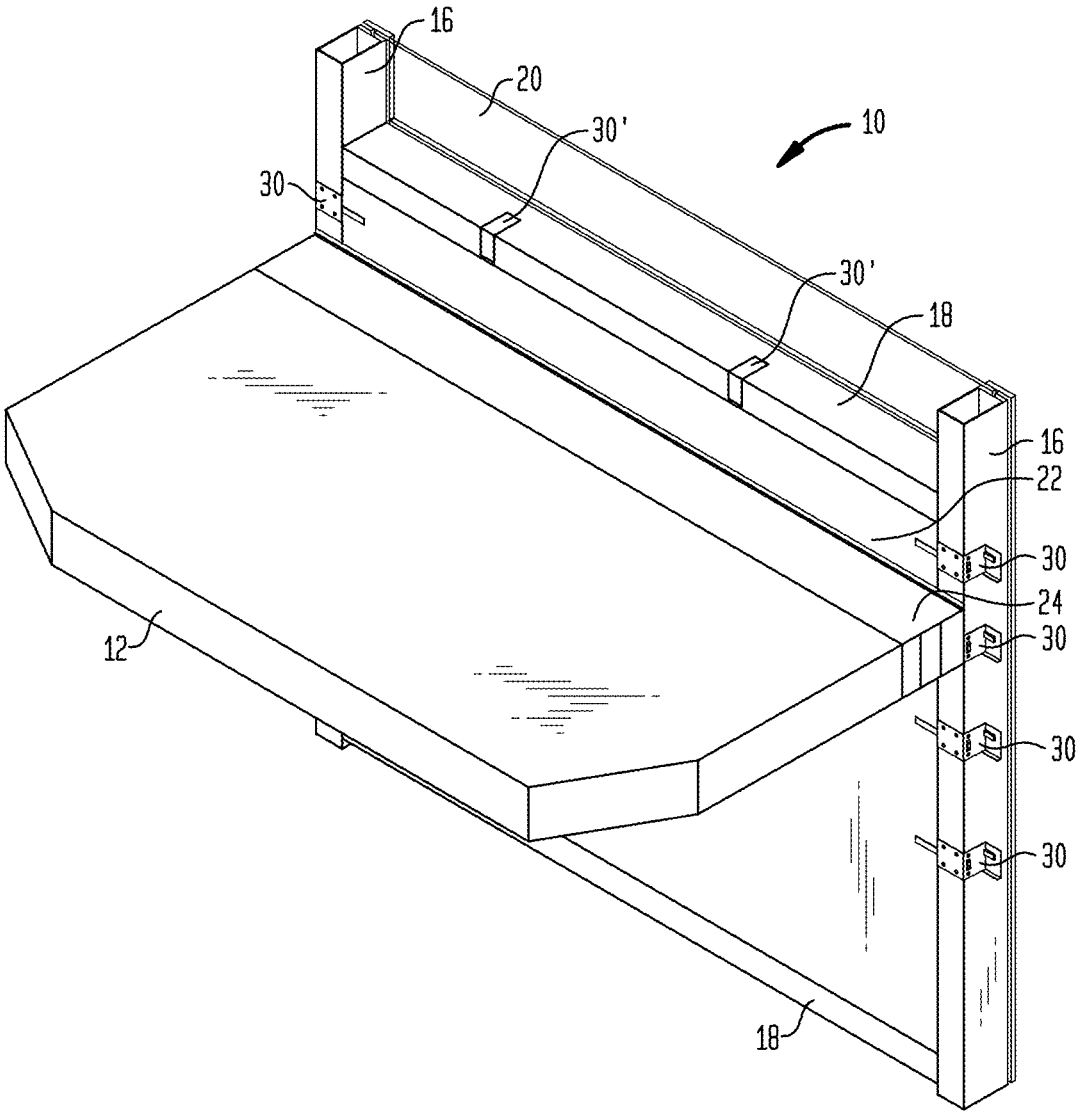
FIG. 2 is an isometric view similar to FIG. 1 with the spandrel insulation included.

Referring to FIGS. 1 and 2, an exterior wall system is depicted generally at numeral 10. The wall system 10 is connected to a slab 12, which forms one of the floors of a multi-floor building. The wall system 10 includes spandrel areas 14 which are covered by spandrels (not shown) that, in one example, define the exterior facade of the building. In some scenarios, spandrel areas 14 extend between the sill of a first vision glass installation and the head of a second vision glass installation. Spandrel area 14 is defined between mullions 16, which provide the vertical framework for wall system 10, and transoms 18, which provide the horizontal framework for wall system 10. Additionally, vision glass 20 may be positioned between portions of mullions 16 and transoms 18.

Referring to FIG. 2, main spandrel insulation 22 is positioned with the spandrel area 14. Spandrel insulation 22 is preferably a fire-retardant insulation that provides a first layer of fire protection for exterior wall system 10. As discussed above, wall system 10 is positioned at a distance spaced from slab 12 and secured thereto. As a result, gap 13 (in FIG. 1) is created between slab 12 and wall system 10. Thus, even though main spandrel insulation 22 is properly positioned, in the event of a fire, smoke, hot gasses, and/or flames any of these conditions may travel through gap 13 between slab 12 and wall system 10 and pass between adjacent floors of the building. In order to prevent and/or delay the passage of smoke, hot gasses, and/or fire between adjacent floors of a building, safing insulation is utilized.

As shown in FIGS. 1 and 2, safing insulation 24 is positioned between main spandrel insulation 22 and slab 12. Safing, as commonly used in construction industry, is made of noncombustible materials. It may be used as fire stop around the perimeter of a floor or around the protrusions or penetrations. In some embodiments, safing insulation 24 is mineral wool insulation. In order to increase the density of safing insulation 24 and, correspondingly, increase the ability of safing insulation 24 to delay and/or prevent the passage of smoke, hot gasses, and/or fire through gap 13 (in FIG. 1), safing insulation 24 is compressed between slab 12 and main spandrel insulation 22. Due to the compression of safing insulation 24, safing insulation 24 exerts a force on both slab 12 and main spandrel insulation 22. As a result of the force applied by safing insulation 24 to main spandrel insulation 22, main spandrel insulation 22 may be deformed. In order to prevent main spandrel insulation 22 from deforming due to the forces exerted by compressed safing insulation 24, support structure, such as stiffeners 60 (in FIG. 1) may be used. This support structure extends between opposing mullions 16 and provide a rigid area against which safing insulation 24 may press. For example, stiffeners 60 are sufficiently strong to resist deformation due to the forces exerted by compressed safing insulation 24. Thus, by utilizing support structure, such as stiffeners or other mechanical backer bars, such as metal angles or hat channel, deformation of main spandrel insulation 22 is substantially or entirely prevented.

Figure 3:
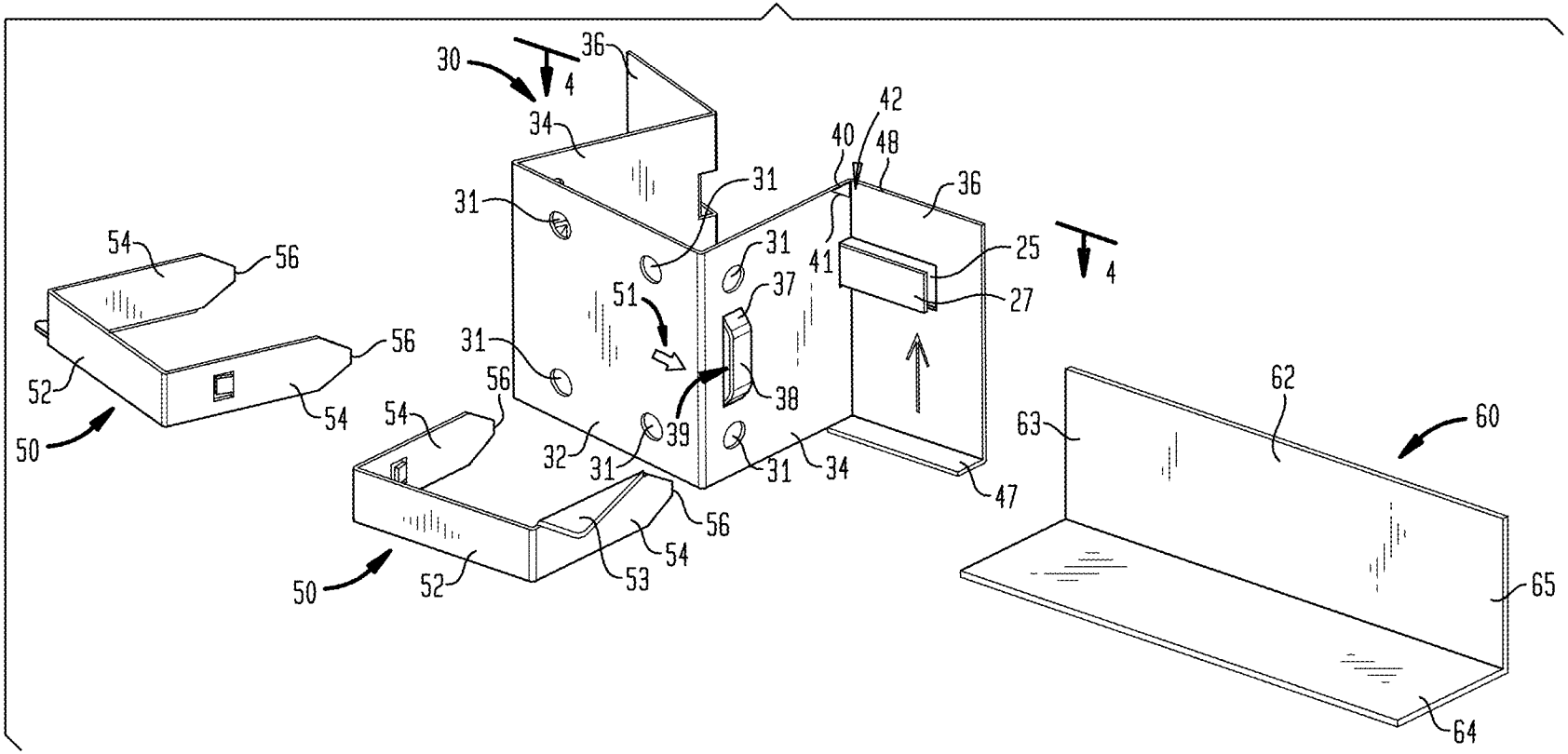
FIG. 3 is an isometric view of an example of a bracket and clips, and a stiffener in some embodiments.

In FIG. 3, in some embodiments, bracket 30 and clip 50 system configured to facilitate installation of the stiffeners 60 and the spandrel insulation are described. An example of a bracket 30 includes a bridge 32 extending between a pair of legs 34. Each leg 34 includes an outwardly extending flange 36 configured to engage and support the rear surface of the spandrel insulation 22, as will be described hereinafter.

Figure 4:
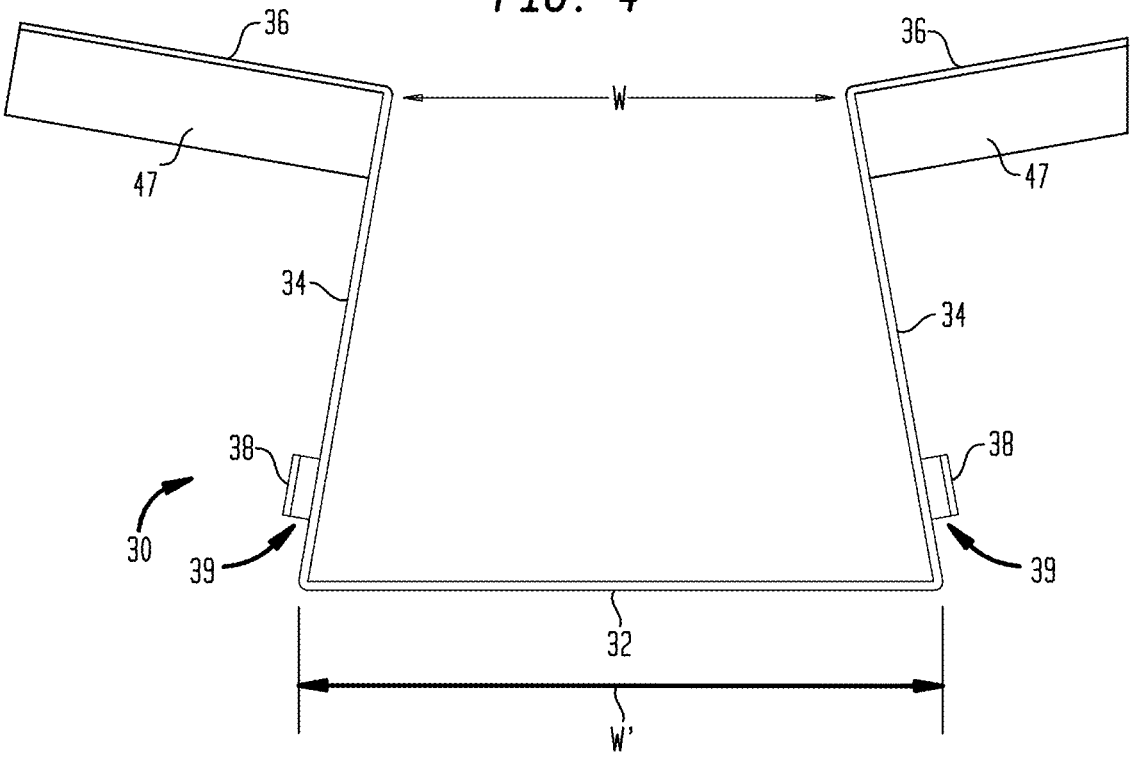
FIG. 4 is a cross-sectional view of the bracket along the lines 4-4 in FIG. 3.

In FIG. 4, legs 34 of bracket 30 are each about at a 90° angle with respect to bridge 32, although the angle can be more or less than 90°. An open channel 33 is defined between legs 34 having a width W which is approximately the same or slightly smaller than the width w of the mullions 16 or transoms 18 (see FIG. 1). Bridge 32 has a width W' that is not smaller than the width w of the mullions. With such configuration, bracket 30 is configured to receive either a mullion 16 or transom 18 into channel 33 with a friction fit. In this manner, bracket 30 may be installed onto mullion 16 or transom 18 by simple forcing thereon, for example, with a rubber mallet, and without the need for any fasteners or the like.

Returning to FIG. 3, alternatively, and/or additionally, bracket 30 may include one or more screw holes 31 on bridge 32 or on any of leg 34, the one or more screw holes 31 allow the bracket to be fixedly attached to the mullion or transom by screw. The screw may be used on either bridge 32 or leg 34 where permitted per the structure of the mullion or transom. In some embodiments, to assist in retaining spandrel insulation 22 (in FIG. 2), each leg 34 includes a first receiving slot 39 defined between a slot plate 38 and leg 34. Slot plate 38 is supported by slot side walls 37 which extend between leg 34 and slot plate 38. Slot plate 38 and slot side walls 37 may be formed through a stamping process or otherwise formed.

Each receiving slot 39 is configured to receive a clip leg 54 of a respective clip 50. Each clip 50 includes a clip bridge 52 extending between a pair of clip legs 54 such that clip 50 has a substantially U-shape. The free end 56 of each clip leg 54 has a tapered configuration. The tapered free end 56 facilitates passage into the receiving slot 39 or provides a sharpened tip for penetrating the spandrel insulation 22, as will be described hereinafter.

Figure 5:
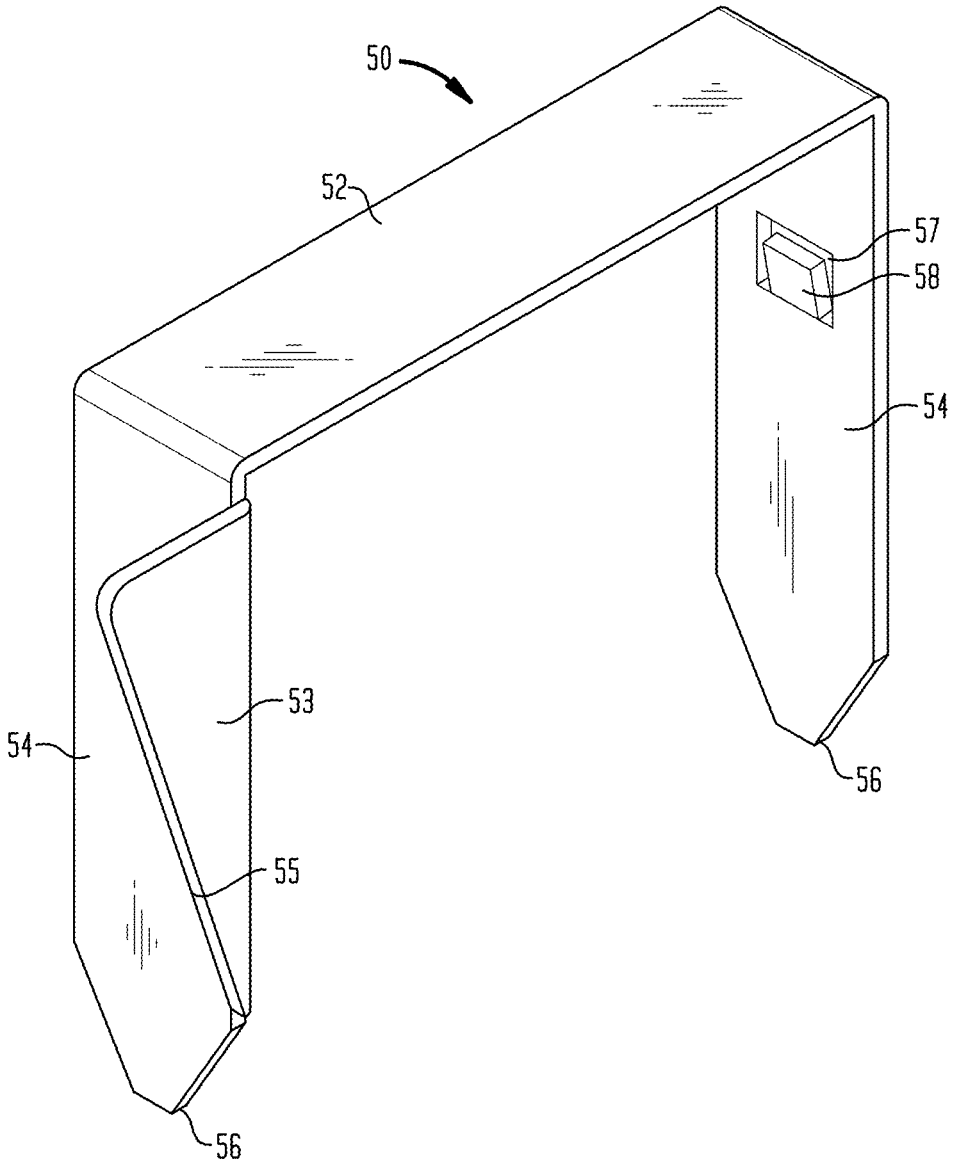
FIG. 5 is an isometric view of an example of a clip in some embodiments.

In FIG. 5, in some embodiments, at least one of the pair of clip legs 54 has a wing 53 that extends at a right angle from the surface of clip leg 54. Wing 53 has an outer edge 55 that is wedged from a portion distal from free end 56 towards free end 56 of the clip leg 54. When one of the pair of clip legs 54 is engaged into receiving slot 39 of the bracket 30 (FIG. 3), wing 55 on the other leg is inserted into the spandrel insulation. This helps retain the spandrel insulation in the spandrel space and also prevent the spandrel insulation from moving longitudinally (or up and down) along the mullion.

Figure 9:
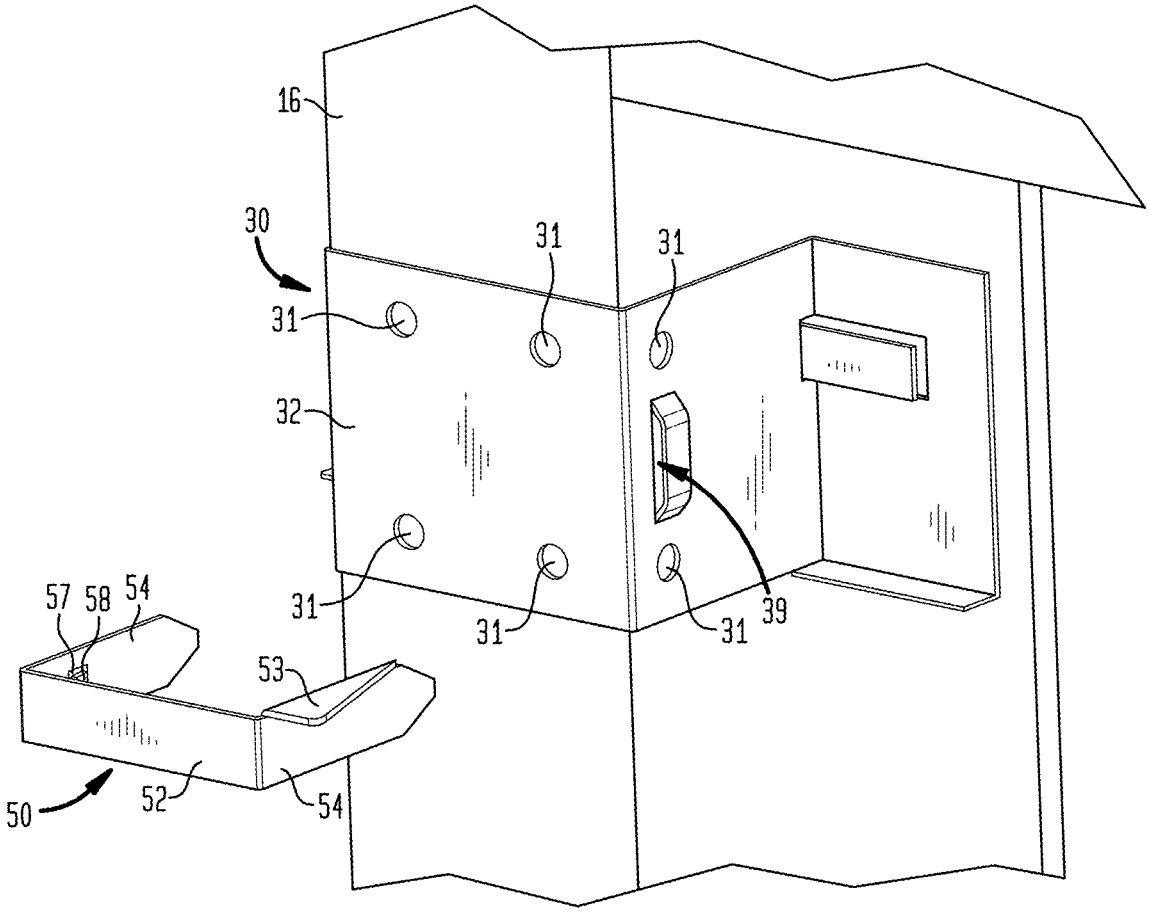
Figure 10:
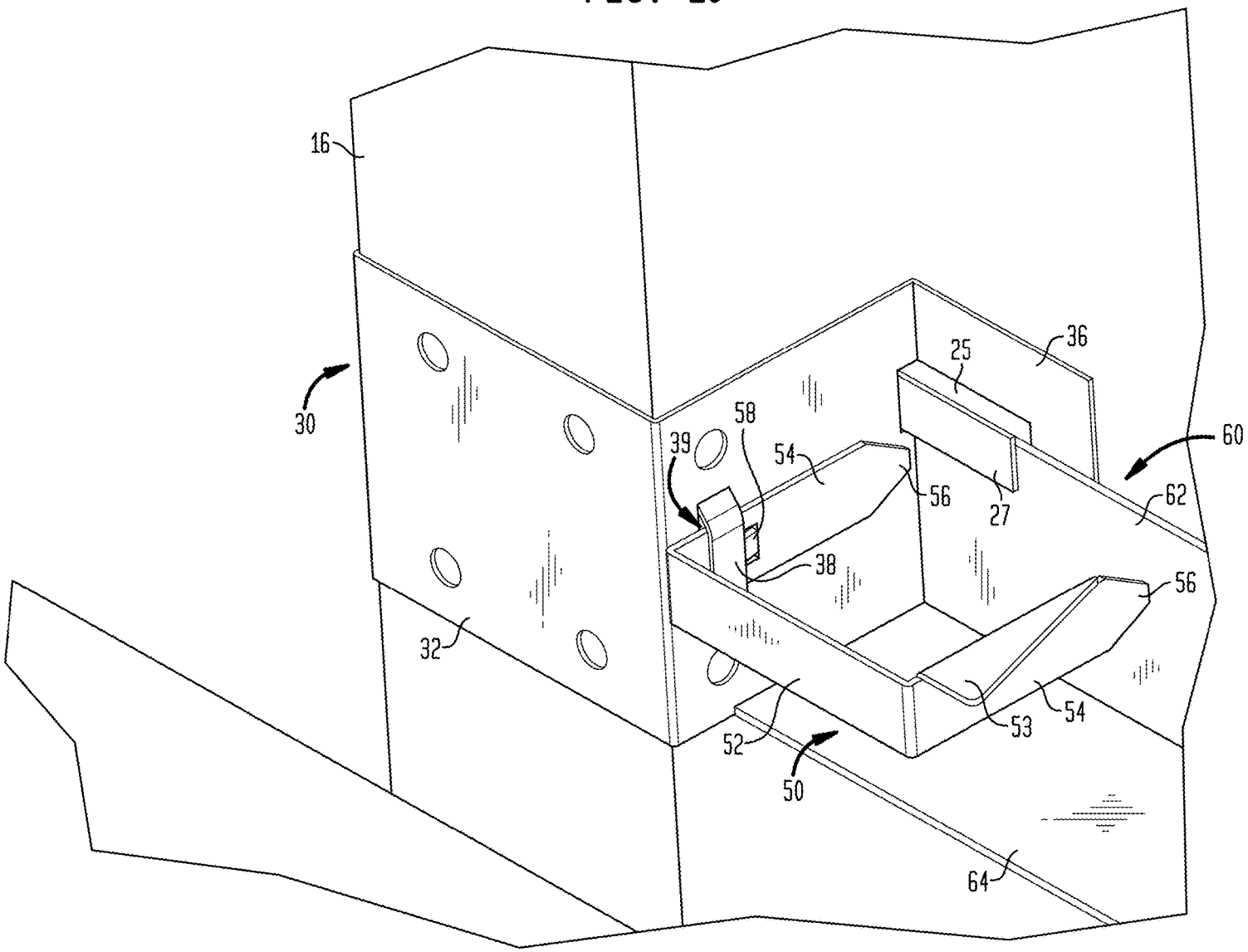

In some embodiments, each clip leg 54 defines an inwardly extending projection 58 extending from notch 57 defined in clip leg 54. As shown in FIGS. 9 and 10, as clip leg 54 is passed through a respective bracket receiving slot 39, the inwardly extending projection 58 biases into notch 57 as it passes slot plate 38 and once fully inserted, returns to the natural inwardly extending position such that projection 58 engages slot plate 38 and maintains clip 50 engaged with bracket 30.

Figure 6:
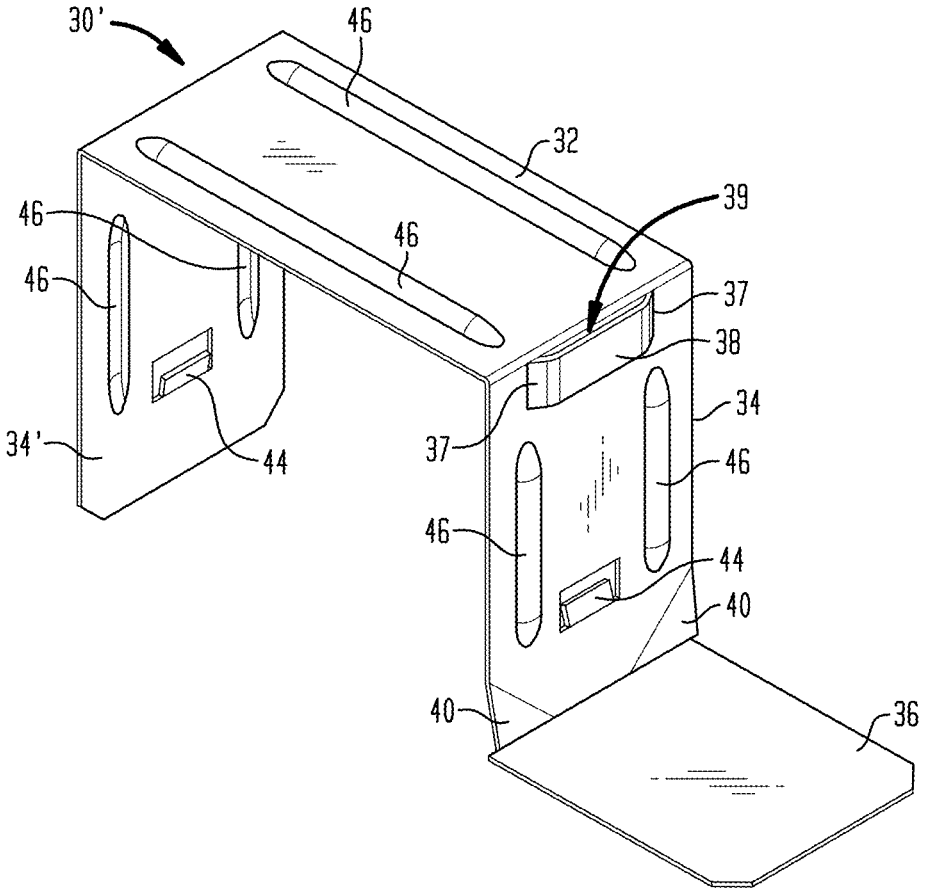
FIG. 6 is an isometric view of an example of a bracket in some embodiments.

FIG. 6 illustrates an alternative bracket 30', for which one of the legs 34' may be free of the flange. For example, when bracket 30' is to be used along transom 18 (FIG. 1) or along a corner mullion 16 (FIG. 1) which has a spandrel area on only one side of the mullion, the flange is not extending in front of vision glass 20 (FIG. 1). Bracket 30' illustrated in FIG. 6 also illustrates other optional features including an inwardly extending projection 44 on each leg 34 to assist in securing the bracket. For example, extending projection 44 may be positioned to contact the mullion or transom and help to further retain the bracket in position. Bracket 30' also may include reinforcing ribs 46. In other regards, bracket 30' functions in the same manner as bracket 30 to be described hereinafter. Alternatively, and/or additionally, bracket 30 also may include the inwardly extending projections 44 on legs 34 and/or reinforcing ribs 46.

Figure 7:
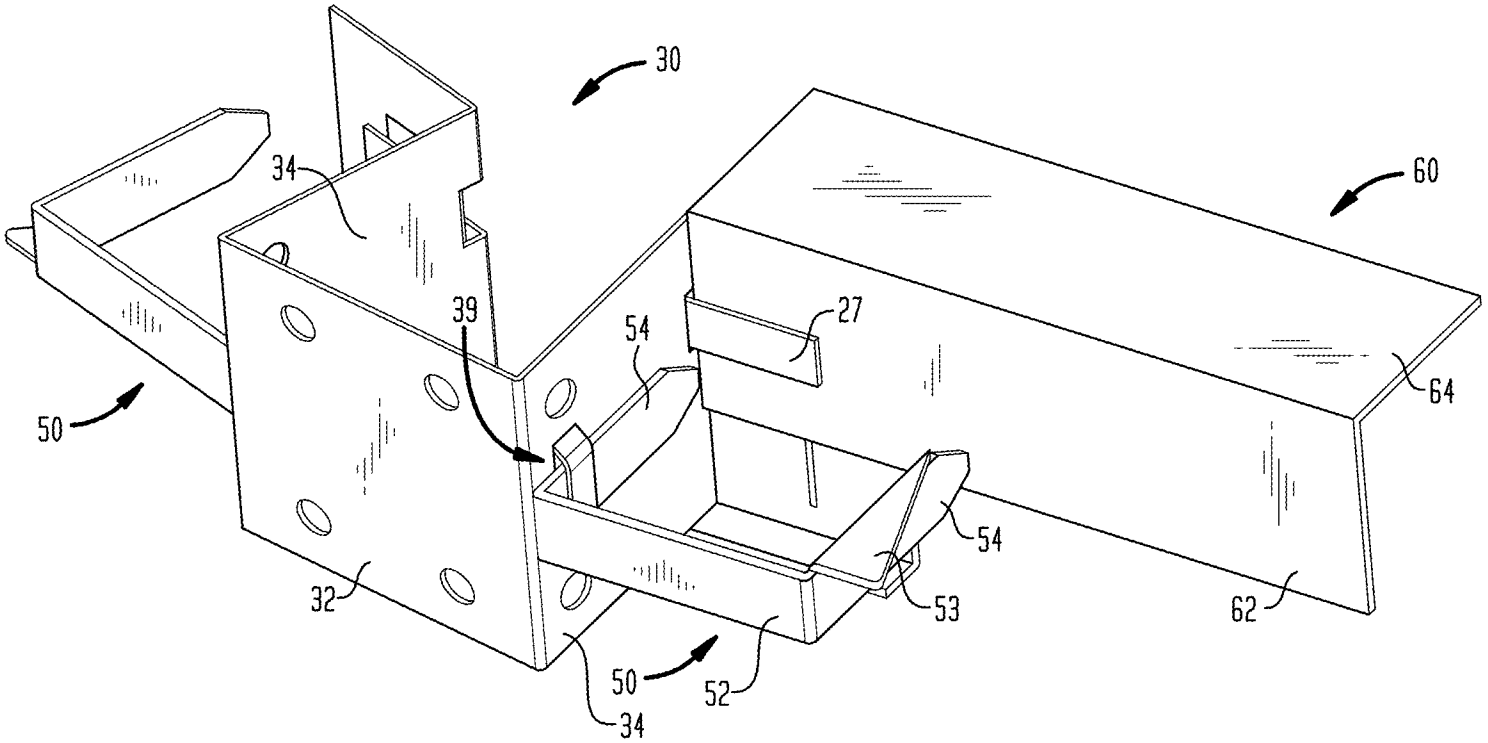
FIG. 7 is an isometric view illustrating a pair of clips and a stiffener engaged with the bracket of FIG. 3.
Figure 8:
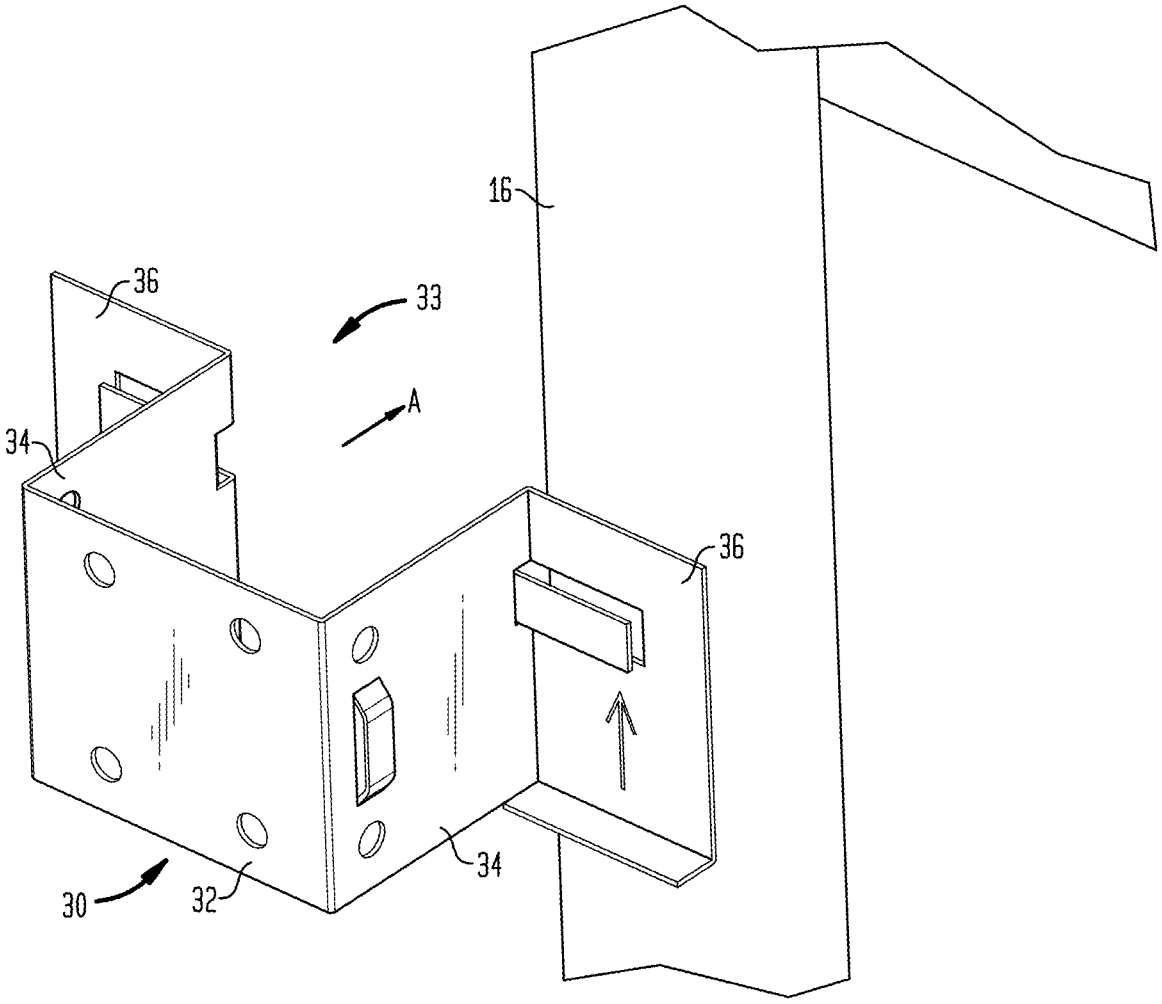
FIGS. 8-14 are isometric views illustrating installation of brackets and clips relative to spandrel insulation and positioning of stiffener in some embodiments.

Referring to FIGS. 3 and 6, brackets 30, 30' are also configured to support stiffeners 60 between two opposing mullions 16 (FIG. 1). Each leg of bracket 30 may further include a second receiving slot 25 along the surface of flange 36. In some embodiments, receiving slot 25 may be formed by a cut plate 27 that is a portion of the flange 36 that is cut and raised from the surface of flange 36 to be at a distance therefrom, such that receiving slot 25 allows receiving a face plate of stiffener 60. Once the face plate of the stiffener is received by receiving slot 25, it is retained in place by cut plate 27. FIG. 7 shows a stiffener that is received in the receiving slot behind cut plate 27.

Returning to FIG. 3, flange 36 may have an additional flange 47 extending from flange 36 at the bottom outwardly towards bridge 32 of the bracket. The additional flange 47 serves as a support for the stiffener. An embodiment of stiffener 60 as shown in FIG. 3 is an L-shaped angle bar that has a vertical face plate 62 and a horizontal face plate 64. An end portion 63 of vertical face plate 62 of stiffener 60 may be received into receiving slot 25 of a first bracket 30 that is attached to a mullion, whereas horizontal face plate 64 is positioned to stay atop flange 47 of bracket 30. A second bracket (not shown) can be attached to an opposing mullion and can be used to receive an opposing end 65 of vertical side 62 of stiffener 60 and also support the stiffener.

To install the angle bar as shown in FIG. 3 between two opposing brackets, the stiffener may be installed from the bottom, in that vertical face plate 62 of the stiffener may first be slid upwardly at an angle from the bottom into receiving slots 25 of two opposing brackets, then tilted straight up while being slid into receiving slots 25 until horizontal face plate 64 of the stiffener passes above bottom flange 47 of the bracket. Then the stiffener may be dropped so that its horizontal face plate 64 rests on top of bottom flange 47, while vertical side 62 is maintained in position in receiving slots 25 of opposing two brackets.

Bottom face plate 64 of the L-shaped angle bar provides support to the upper mineral wool panel that fills in the spandrel panel area. The stiffener also acts as a stiffener to reinforce the area at the edge of slab. Once installed, the stiffener maintains compression on the mineral wool safing insulation, but they also keep the over-compressed mineral wool safing sections from damaging the rigid curtain wall insulation.

With reference to FIG. 7, an alternative configuration of stiffener 60 is illustrated. In FIG. 7, the stiffener is a hat channel that is rotated relative to its position in FIG. 3 in that vertical face plate 62 becomes a front face and horizontal face plate 64 extends from vertical face plate 62 towards the rear face of the spandrel insulation away from bridge 32 of bracket 30. The L-shaped angle bar can be installed onto two opposing brackets 30 by directly sliding vertical face plate 62 into the receiving slots behind cut plates 27 of the two brackets from the top until horizontal face plate 64 rests on the top edge 48 of flange 36 (FIG. 3). In such configuration, the curtain wall insulation can be placed inside the spandrel space, without split, past the stiffener and the floor slab.

With reference to FIG. 3, optionally, adjacent to the junction of each leg 34 and flange 36, corner tabs 40 are bent outwardly along line 41 such that a corner receiving slot 42 is defined between each corner tab 40 and flange 36. The corner receiving slot 42 has a width approximately equal to a thickness of vertical face plate 62 of stiffener 60. In the illustrated embodiment, stiffener 60 is a hat channel as shown in the configuration in FIG. 7. Each end of vertical face plate 62 is received in corner receiving slots 42 of a pair of brackets 30 positioned on adjacent mullions 16 (see FIG. 1) such that stiffener 60 is supported therebetween, with the respective flanges 36 extending behind vertical face plate 62 and preventing movement of stiffener 60 away from safing insulation 22 (FIG. 2). Corner tab 40 serves two purposes. It helps to hold the L-shaped angle that will be used as a stiffener at the floor line. It also gives the bracket some rigidity and strength.

Referring to FIGS. 1, 2 and 8-10, an example of a process for installing the spandrel insulation is described. The process may include: attaching a plurality of spaced-apart brackets, each bracket having a first receiving slot; positioning the insulation in a space adjacent to the mullions and/or transoms; and engaging with each bracket a clip having a pair of clip legs with a first of the pair of clip legs extending through the first receiving slot of the bracket and a second of the pair of clip legs penetrating into the insulation, wherein the other clip leg has a tapered free end. The bracket can have various configurations. For example, using the bracket 30, 30' (in FIGS. 3 and 6), the process may include attaching a plurality of spaced-apart brackets 30, 30' to mullions 16 and transoms 18 (FIG. 1), either by friction fit or by screw or bolt or by other methods. In friction fit, each bracket 30, 30' is positioned by aligning open channel 33 with mullion 16 or transom 18 and forcing bracket 30, 30' as indicated by arrow A in FIG. 8 into friction fit on mullion 16 or transom 18. With brackets 30, 30' so positioned, the process may further position spandrel insulation 22 in spandrel space 14 with the rear surface thereof supported by flanges 36. Thereafter, the process may engage a clip 50 with each bracket 30, 30', with one of clip legs 54 extending through a respective receiving slot 39 and the other clip leg 54 penetrating into spandrel insulation 22.

As shown in FIG. 3, bridge 32 of bracket 30 may have a mark 51 on the outside surface of the bridge to show the location of receiving slot 39, which is already covered by spandrel insulation 22. This allows easy installation of clip 50 after the leg of the bracket is covered by the spandrel insulation. Once each clip is engaged with the bracket, projection 58 of each clip leg 54 engages respective slot plate 38 such that clips 50, and thereby the spandrel insulation 22. is retained by brackets 30, 30' and clips 50.

Optionally, before positioning the insulation in the space adjacent to the mullion or transom, the process may include: attaching two opposing brackets onto two opposing mullions, respectively; and installing a stiffener onto the two opposing brackets by sliding a vertical face plate of the stiffener into a second receiving slot of each of the two opposing brackets. The second receiving slot for each bracket may be formed by a portion of the flange that is cut and raised from a surface of the flange of each respective opposing bracket.

With reference to FIG. 3, an example of the above process may include attaching two opposing brackets 30 on two opposing mullions proximate to the floor slab and installing stiffener 60 onto two opposing brackets 30. In some embodiments, the stiffener may be an L-shaped angle bar as shown in FIG. 10, and the process may include sliding vertical face plate 62 of the angled bar at an angle upwardly into receiving slots 25 of each bracket 30 from the bottom, tilting vertical face plate 62 while being slid upwardly until horizontal face plate 64 of angled bar 60 passes above the bottom flange (47 in FIG. 3), and dropping the stiffener to allow it to sit on top of bottom flange 47. Once stiffener 60 is installed, the process of positioning spandrel insulation 22 may include positioning a split panel of the spandrel insulation into the top of the bottom flange (47 in FIG. 3). Alternatively, stiffener 60 is a hat channel, and the process may include sliding the vertical face plate of the hat channel to receiving slots 25 of each bracket 30 from the top until the horizontal face plate of the hat channel rests on the top edge 48 of flange 36 (FIG. 3).

In above various illustrated embodiments, bracket 30, 30', clip 50, and stiffener 60 (FIG. 3) can be made of steel or other metal. Bracket 30, 30' also may be made of elastic materials to allow for friction fit on the mullion or transom. Other materials may be used as appreciated by one of ordinary skill in the art.

Figure 11:
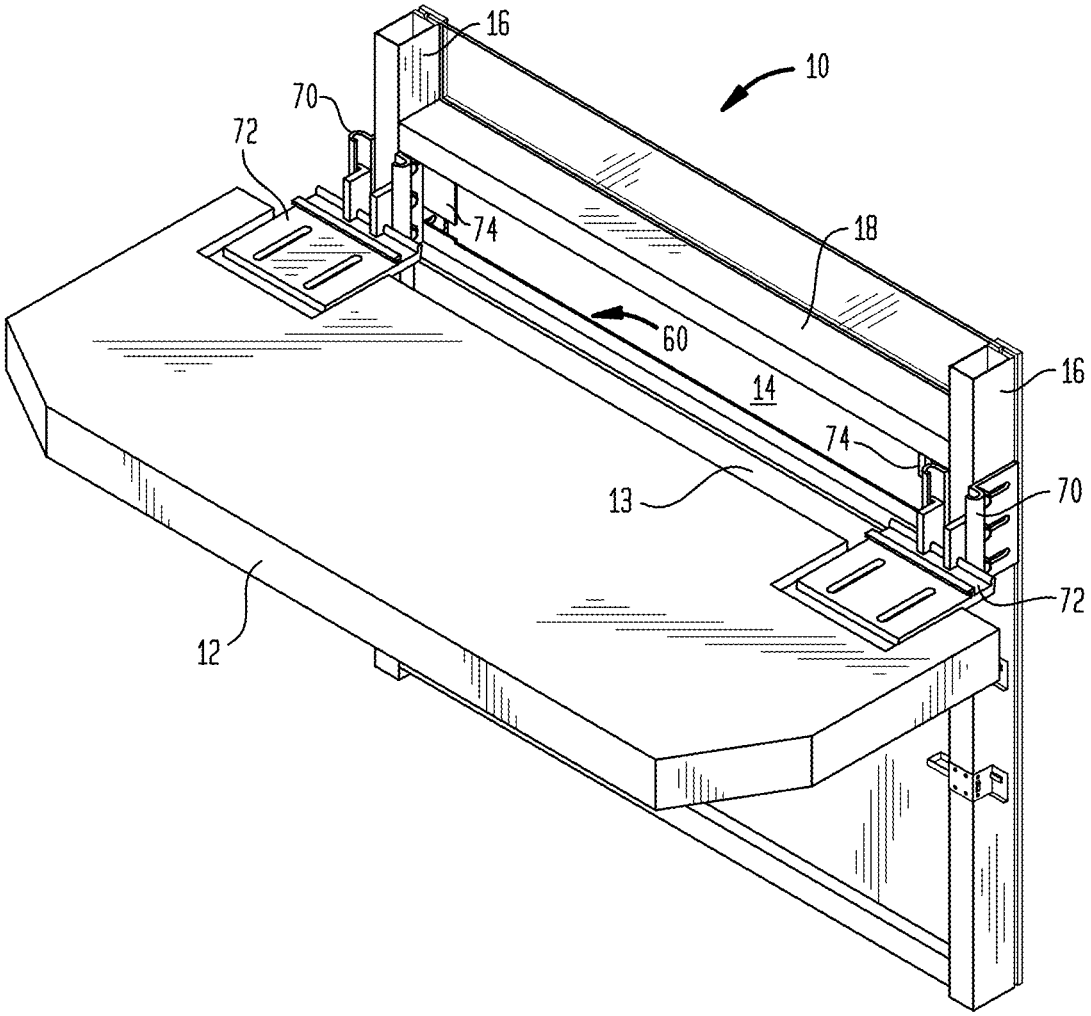

With reference to FIG. 11, the bracket may vary to accommodate different structures in the building in which the curtain wall insulation is installed. For example, a floor slab 12 may be attached to a mullion 16 by an anchor attachment 70, 72. This may interfere with the bracket (30 in FIG. 1) near the floor line.

Figure 12:
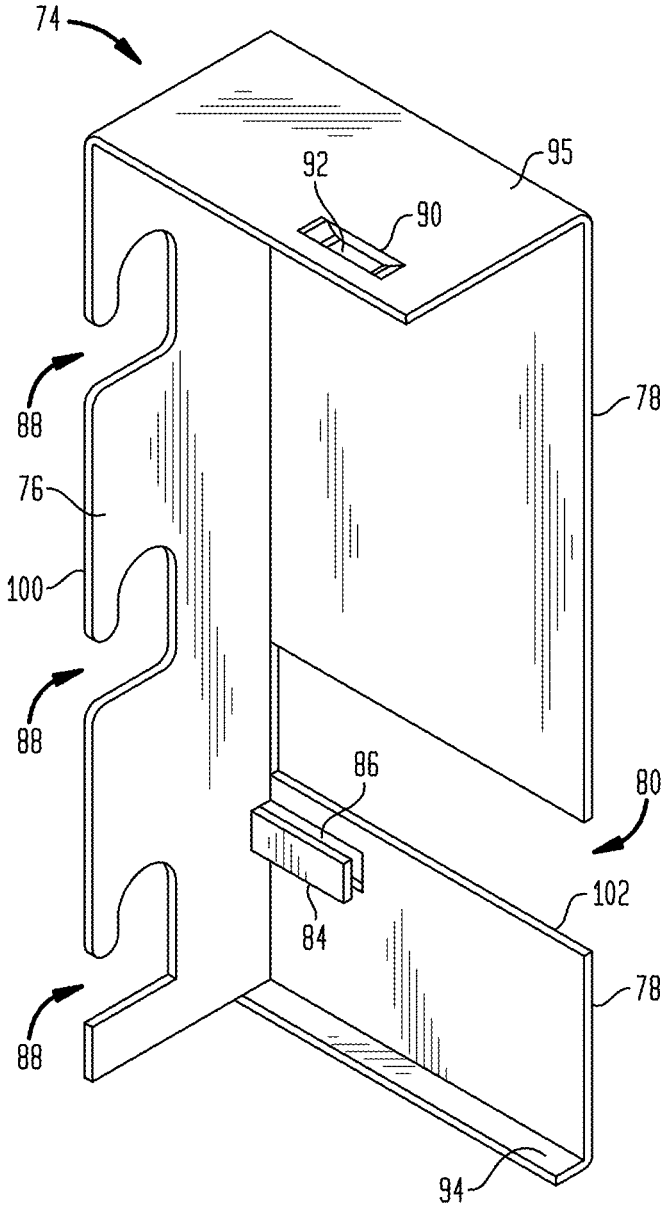

In FIG. 12, in some embodiments, a bracket 74 may include a side plate 76 defining at least one aperture 88 positioned to engage with a fastener for attaching the side plate 76 to a side surface of the mullion, which will be described in detail later in this document. Bracket 74 may also include a back plate 78 extending perpendicularly from the side plate 76 and defining a first receiving slot 86 formed by a portion 84 of the back plate 78 that is cut and raised from a surface of the back plate, wherein the first receiving slot 86 is configured to receive a face plate of a stiffener, which will be explained later.

The back plate 78 may include a flange 94 extending outwardly from the bottom of the back plate 78 towards a front edge of the side plate 100. Back plate 78 may also have a top edge 102 near the first receiving slot 86. Aperture 88 in the side plate 76 may also include an opening through the front edge 100 of the side plate 76 to allow the side plate 76 to slide into an anchor attachment to the mullion so that the aperture in the side plate engages with a fastener of the anchor attachment. This is further explained with reference to FIG. 13.

Figure 13:
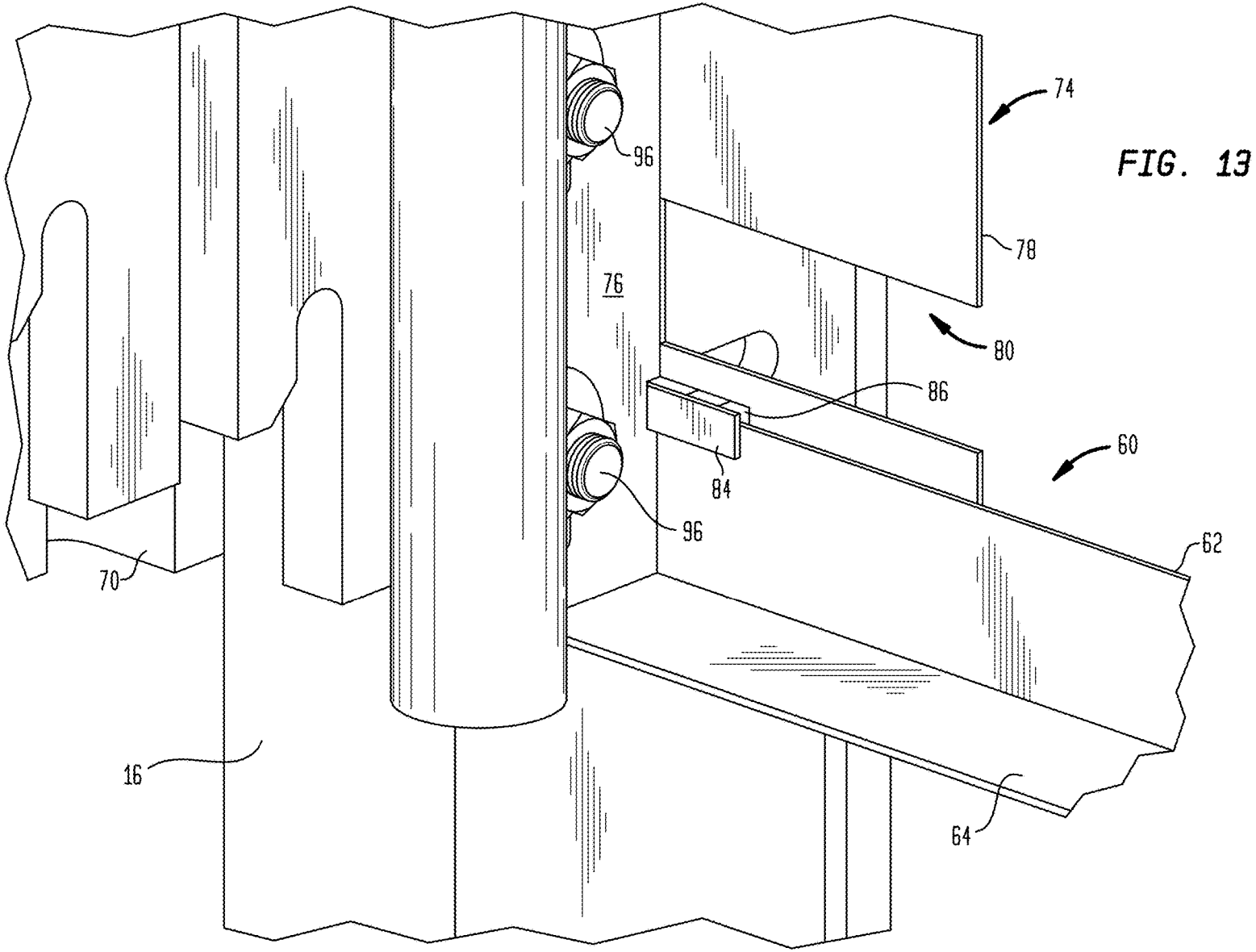

In FIG. 13, a part of an anchor attachment 70 is attached to a mullion 16, where part 70 is engaged with a second part 72 of the anchor attachment for attaching the slab to the mullion (see FIG. 11). Part 70 of the anchor attachment is attached to the mullion via fasteners 96, such as bolts and screws. In attaching the bracket 74 to the mullion 16, a method may use existing fasteners 96 that fasten the anchor attachment 70 to the mullion 16 to fasten the bracket. In a non-limiting example, an installation method may include loosening the fasteners 96 and sliding the side plate 76 of the bracket 74 into the anchor attachment so that the apertures (88 in FIG. 12) are engaged with the fasteners 96, such as bolts. This is further explained with reference to FIGS. 12 and 13. The opening of the aperture 88 is positioned to be aligned with a bolt 96 of the anchor attachment 70 to allow the side plate 76 to slip right into the anchor attachment without having to remove the anchor attachment 70 from the mullion 16. While the bolt 96 is slipped into the respective aperture 88 of the side plate 76, the aperture 88 engages with the bolt 96. Then, the method may include tightening the fasteners 96 to secure both the anchor attachment 70 and the side plate 76 of the bracket 74 to the mullion 16.

With further reference to FIG. 13, similar to bracket 30 described earlier in this document (e.g., in FIG. 10), a stiffener 60 may be an L-shaped bar, and the first receiving slot 84 of the back plate 78 may be positioned to receive a vertical face plate 62 of the stiffener 60. The flange of the back plate (94 in FIG. 12) may be positioned to support a horizontal face plate 64 of the L-shaped bar 60. In some embodiments, with reference to FIGS. 7 and 12, the stiffener 60 is a hat channel having a vertical face plate 62 positioned in the first receiving slot 84 of the back plate 78 of the bracket 74 and a horizontal face plate 64 extending inwardly from the vertical face plate further away from the front edge of the side plate of the bracket and positioned to rest on the top edge (102 in FIG. 12) of the back plate 78.

Returning to FIG. 12, bracket 74 may additionally have a top plate 95 extending perpendicularly from the side plate 76 and defining a second receiving slot 90 that is configured to receive a clip leg of a respective clip to engage the insulation. The clip is described earlier in this document (e.g., clip 50 in FIG. 3) and works the same way with the bracket 74 as it works with bracket 30.

Referring to FIGS. 1, 2 and 8-14, an example of a process for installing the spandrel insulation relative to a mullion and/or a transom may include: attaching two opposing brackets (e.g., 74 as described in FIG. 12) onto two opposing mullions, respectively, by engaging each bracket into an anchor attachment for each respective mullion, wherein the anchor attachment attaches the mullion to a floor slab. The process may also include installing the stiffener onto the two opposing brackets by sliding a vertical face plate of the stiffener into the second receiving slot of each of the two opposing brackets, which was described in the embodiments in FIG. 13. The process may also include positioning the insulation in a space defined between the two opposing mullions adjacent to the stiffener.

Figure 14:
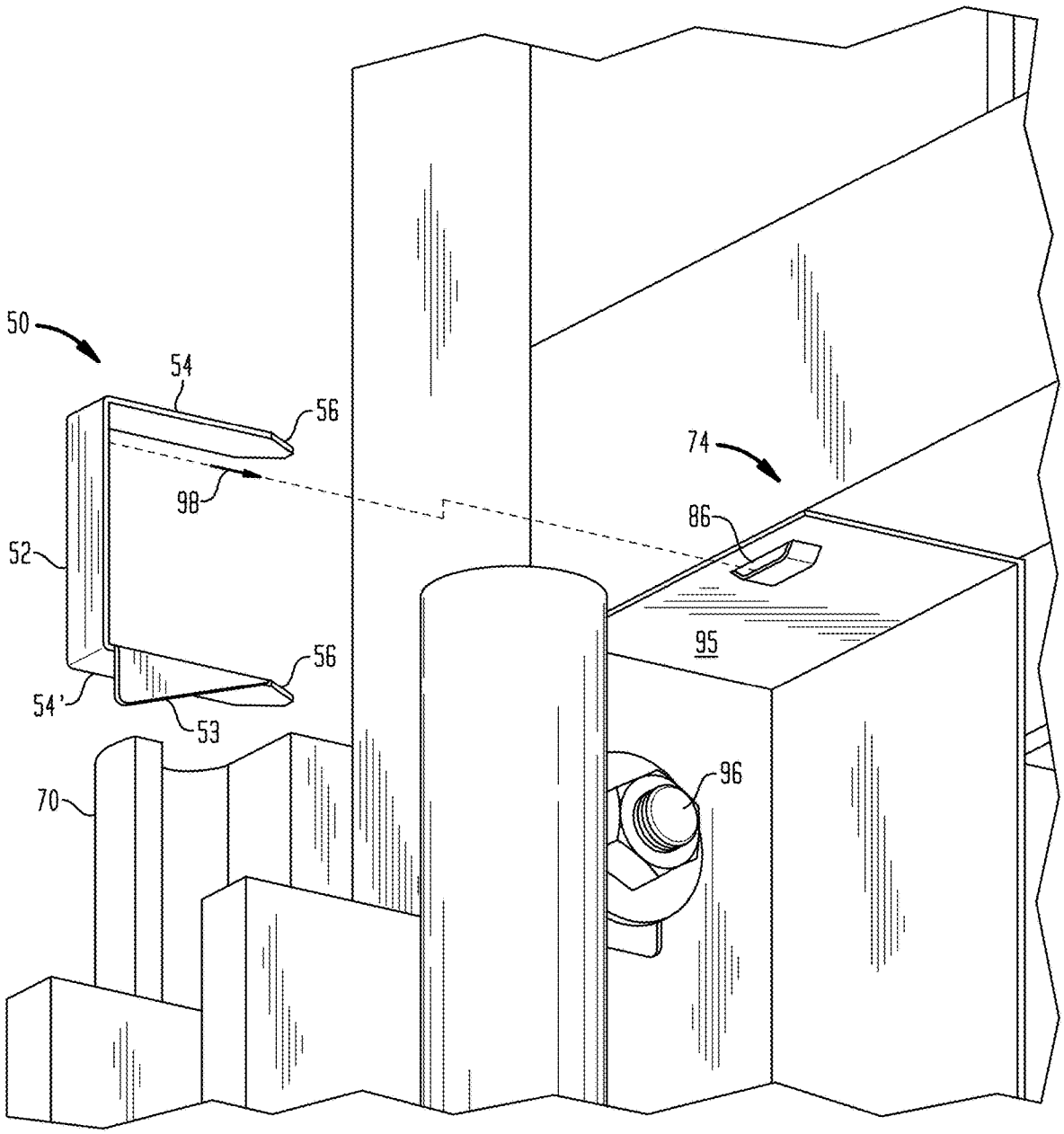

With reference to FIG. 14, the installation process may also include engaging the insulation by engaging each bracket with a clip having a pair of clip legs (e.g., a pair of clip legs described in the embodiments in FIG. 3). In a non-limiting example, the installation process may include: extending inwardly from a front edge of the side plate towards the back plate the first clip leg of the pair 54 through a second receiving slot 86 of the bracket 74 formed on a top plate 95 that extends perpendicularly from the side plate. This is shown in the direction 98. The process may also include penetrating the second clip legs of the pair 54' inwardly from a front side of the insulation towards the back plate of the bracket into the insulation (shown in direction 98).

The above-illustrated embodiments provide advantages over the existing systems. For example, the brackets can be attached to the mullion or transom quickly by a friction fit or a single screw without laborious installation as in installation of curtain wall in a conventional manner. Further, once the insulation is installed, the clips that engage with the bracket can be quickly inserted into the first receiving slot of the bracket with accuracy because the location of the receiving slot on the leg of the bracket can be determined from the mark on outside surface of the bracket, which is exposed. This allows for easy alignment of the clip.

Still further, the clip has both a tapered leg and a wing extending at a right angle from the tapered leg, so that when the clip is inserted into the spandrel insulation it allows the spandrel insulation to be retained inside the spandrel space without movement. Still further, the free end of the tapered leg of the clip is facing inward towards the spandrel insulation, thus, pushing the clips during installation creates no dangerous situation to the human installer as in other existing systems. Still further, the above-illustrated embodiments of the stiffener provide various ways to contend with floor slab attachment points for the curtain wall panels themselves that may be located at or near those points, which allows for proper installation. Still further, variations of the bracket are also shown above that may be attached to an anchor attachment that attaches the floor slab to the mullion so that the anchor attachment does not interfere with the bracket.

These and other advantages of the present invention will be apparent to those skilled in the art from the foregoing specification. For example, an insulation retaining system may concurrently include one or more variations of the bracket illustrated above that attach to various locations of the mullion/transom. In such a system, one or more brackets (e.g., configurations shown in FIG. 12) may be directly attached to the anchor attachment near the floor line, whereas one or more brackets (e.g., configurations shown in FIG. 3) may be attached to the mullion via friction. Each of the various brackets may be positioned to receive a clip to engage the insulation.

Figure 15:
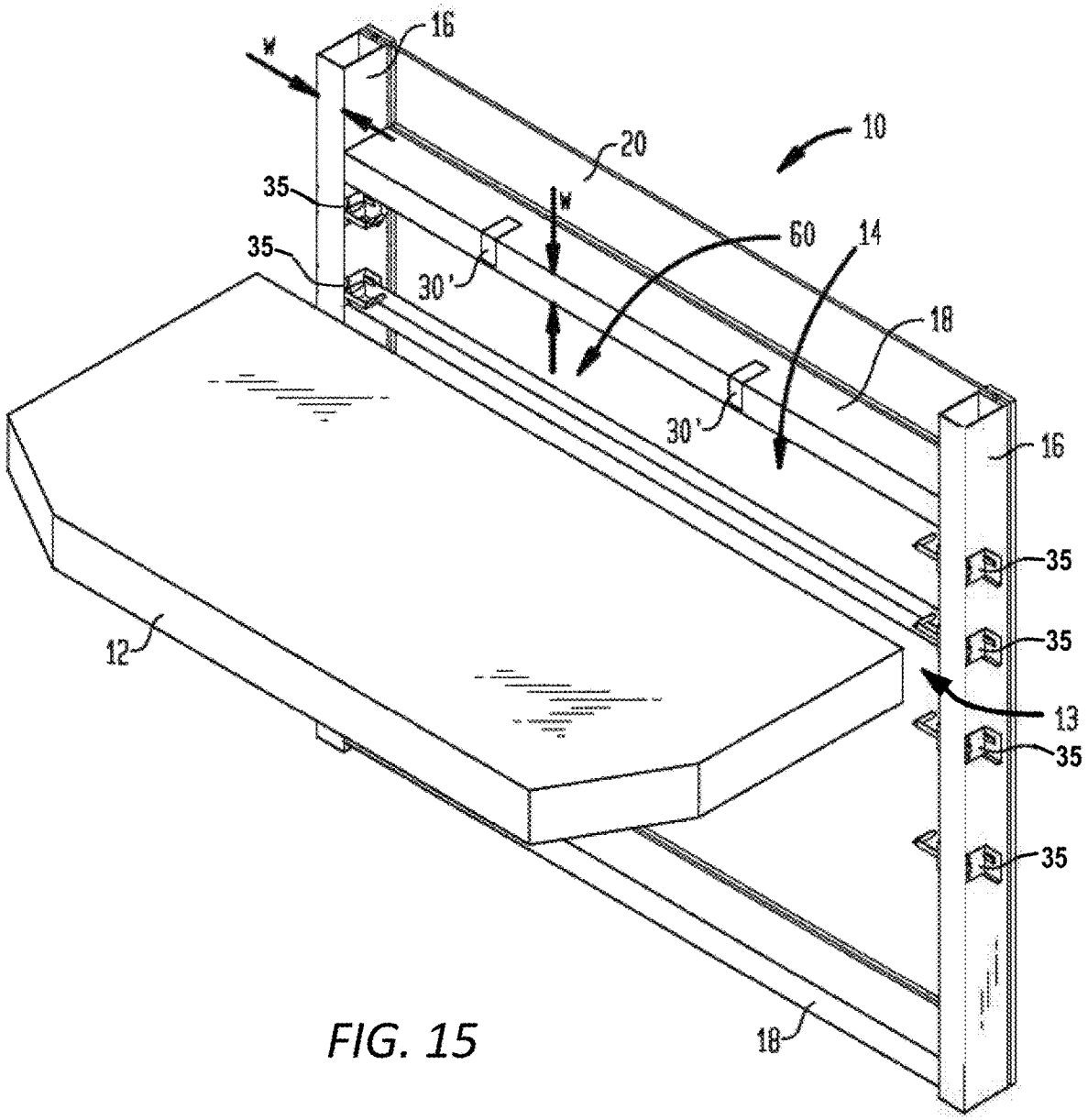
FIG. 15 is an isometric view of a wall system with mullions and transoms defining a spandrel area in which L-brackets are positioned on the mullions and transoms using fasteners, and where the spandrel insulation is omitted from the figure for clarity.
Figure 16:
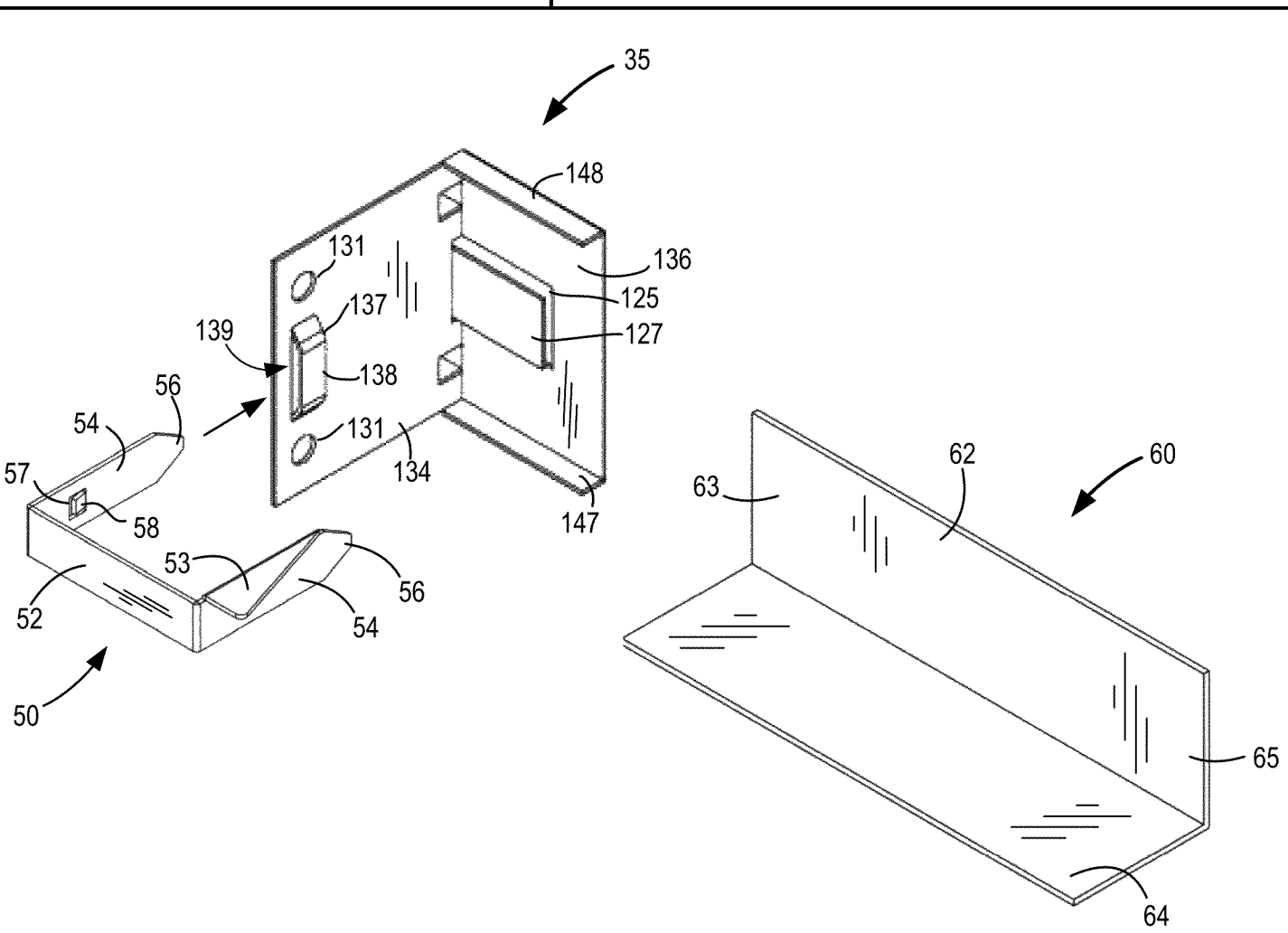
FIG. 16 is an isometric view of a more detailed view of the L-bracket, shown with clips, and a stiffener in some embodiments.
Figure 17:
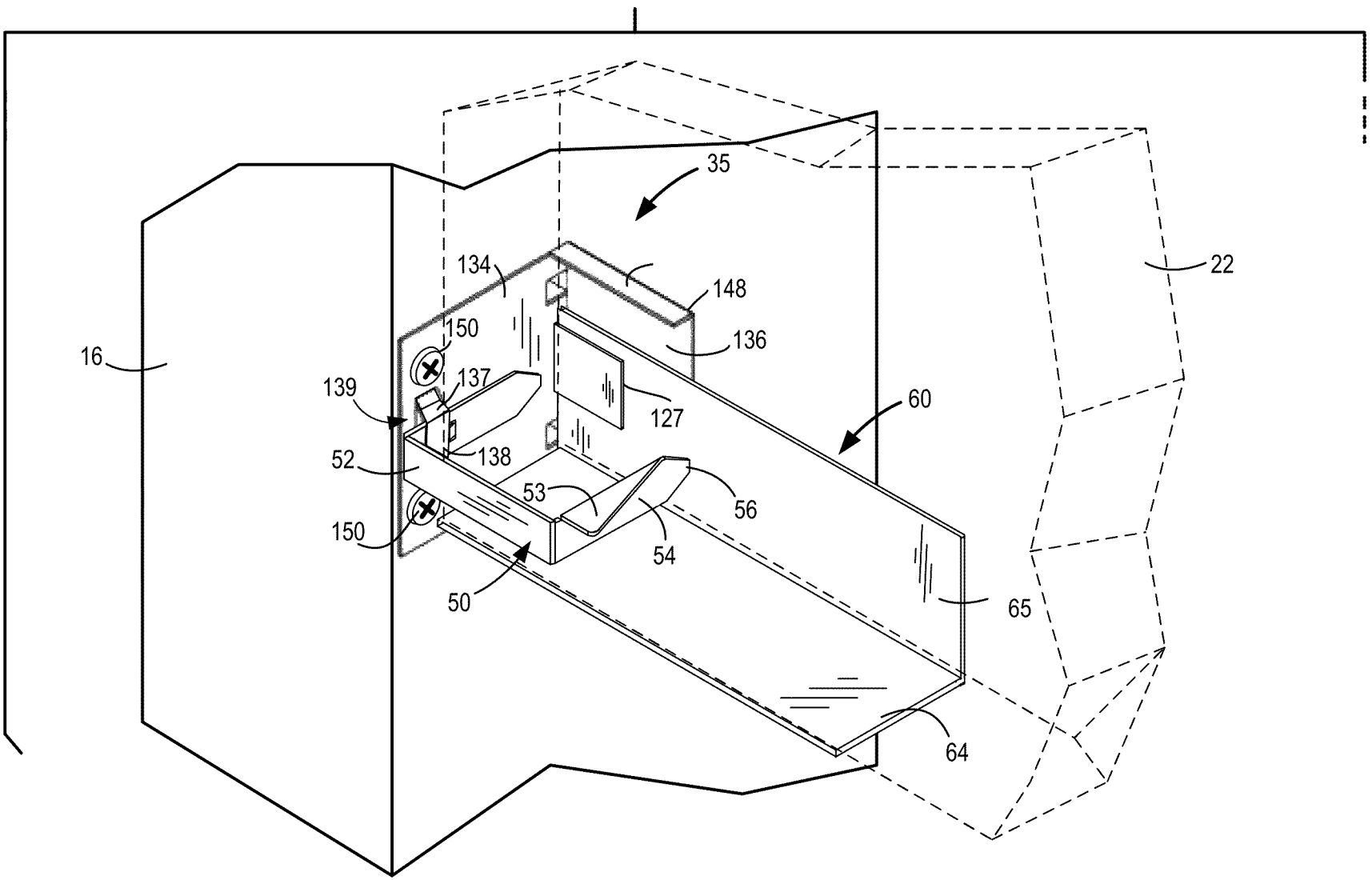
FIG. 17 is an isometric view illustrating the clips and stiffener of FIG. 16 engaged with the L-bracket of FIG. 16.

An example of an alternative bracket is shown in FIGS. 15-17. The bracket 35 is an L-bracket including a side plate 134 which has an outwardly extending flange 136 configured to engage and support the rear surface of the spandrel insulation 22, in a manner similar to that which has already been described above. It can be observed in FIGS. 15 and 16, that the side plates 134 of the brackets 35 are each about at a 90° angle with respect to the flange 136 so as to define the L-shaped configuration. The bracket 35 is configured for attachment to either a mullion 16 or transom 18 using suitable fasteners. For example, the bracket 35 may include one or more apertures 131 on side plate 134 for receiving threaded screws 150. The one or more apertures 131 allow the bracket to be fixedly attached to the mullion or transom by the screws. The screws may be used on the side plate 134 where permitted per the structure of the mullion or transom. In some embodiments, so as to assist in retaining spandrel insulation, each side plate 134 includes a first receiving slot 139 defined between a slot plate 138 and side plate 134. Slot plate 138 is supported by slot side walls 137 which extend between side plate 134 and slot plate 138. Slot plate 138 and slot side walls 137 may be formed through a stamping process or otherwise formed.

Each receiving slot 139 is advantageously configured to receive a clip leg 54 of a respective clip 50 as described herein. Each clip 50 can have a configuration as described above such that the tapered free end 56 facilitates passage into the receiving slot 139 or provides a sharpened tip for penetrating the spandrel insulation 22. Accordingly, when one of the pair of clip legs 54 is engaged in receiving slot 139 of the bracket 35 (FIG. 17), a wing 53 on the other leg is inserted into the spandrel insulation 22. This helps retain the spandrel insulation in the spandrel space and also prevent the spandrel insulation from moving longitudinally (or up and down) along the mullion.

In some scenarios the clip 50 can include an inwardly extending projection 58 which extends from notch 57 defined in clip leg 54. Consequently, as clip leg 54 is passed through a respective bracket receiving slot 139, the inwardly extending projection 58 biases into notch 57 as it passes slot plate 138. Once the clip leg is fully inserted into the slot plate 138 as shown in FIG. 17, the projection 48 returns to the natural inwardly extending position such that projection 58 engages slot plate 138 and maintains clip 50 engaged with bracket 35.

The bracket 35 is also configured to support stiffeners 60 between two opposing mullions 16 in a manner that is similar to that described herein with respect to FIGS. 1 and 2. As such, each bracket 35 may further include a second receiving slot 125 disposed along the surface of the flange 136. In some embodiments, receiving slot 125 may be formed by a cut plate 127. The cut plate 127 can be comprised of a portion of the flange 136 that is cut and raised from the surface of flange 136 to be at a distance therefrom, such that receiving slot 125 facilitates receiving a face plate of stiffener 60. Once the face plate of the stiffener is received by receiving slot 125, it is retained in place by cut plate 127. FIG. 17 shows a stiffener that is received in the receiving slot behind cut plate 127.

Returning to FIG. 16, flange 136 may have an additional flange 147 extending outwardly from a bottom portion of flange 136. The additional flange 147 extends from the face of the flange in a direction such that is perpendicular to both the side plate 134 and the flange 136. The additional flange 147 serves as a support for the stiffener 60 in the form of an angle bar as described herein. An end portion 63 of vertical face plate 62 of stiffener 60 may be received into receiving slot 125 of a first bracket 35 that is attached to a mullion, whereas horizontal face plate 64 is positioned to stay atop flange 147 of bracket 35. A second bracket (not shown) can be attached to an opposing mullion and can be used to receive an opposing end 65 of vertical side 62 of stiffener 60 and also support the stiffener.

To install the stiffener 60 as shown in FIG. 17 between two opposing brackets, the stiffener may be installed from the bottom edge of the flange, in that vertical face plate 62 of the stiffener may first be slid upwardly at an angle from the bottom edge into receiving slots 125 of two opposing brackets, then tilted straight up while being slid into receiving slots 125 until horizontal face plate 64 of the stiffener passes above bottom flange 147 of each bracket. Then the stiffener may be dropped so that its horizontal face plate 64 rests on top of bottom flange 147, while vertical side 62 is maintained in position in receiving slots 125 of opposing two brackets.

Bottom face plate 64 of the L-shaped angle bar provides support to the upper mineral wool panel that fills in the spandrel panel area. The stiffener also acts as a stiffener to reinforce the area at the edge of slab. Once installed, the stiffener maintains compression on the mineral wool safing insulation, but also keeps the over-compressed mineral wool safing sections from damaging the rigid curtain wall insulation.

Figure 18:
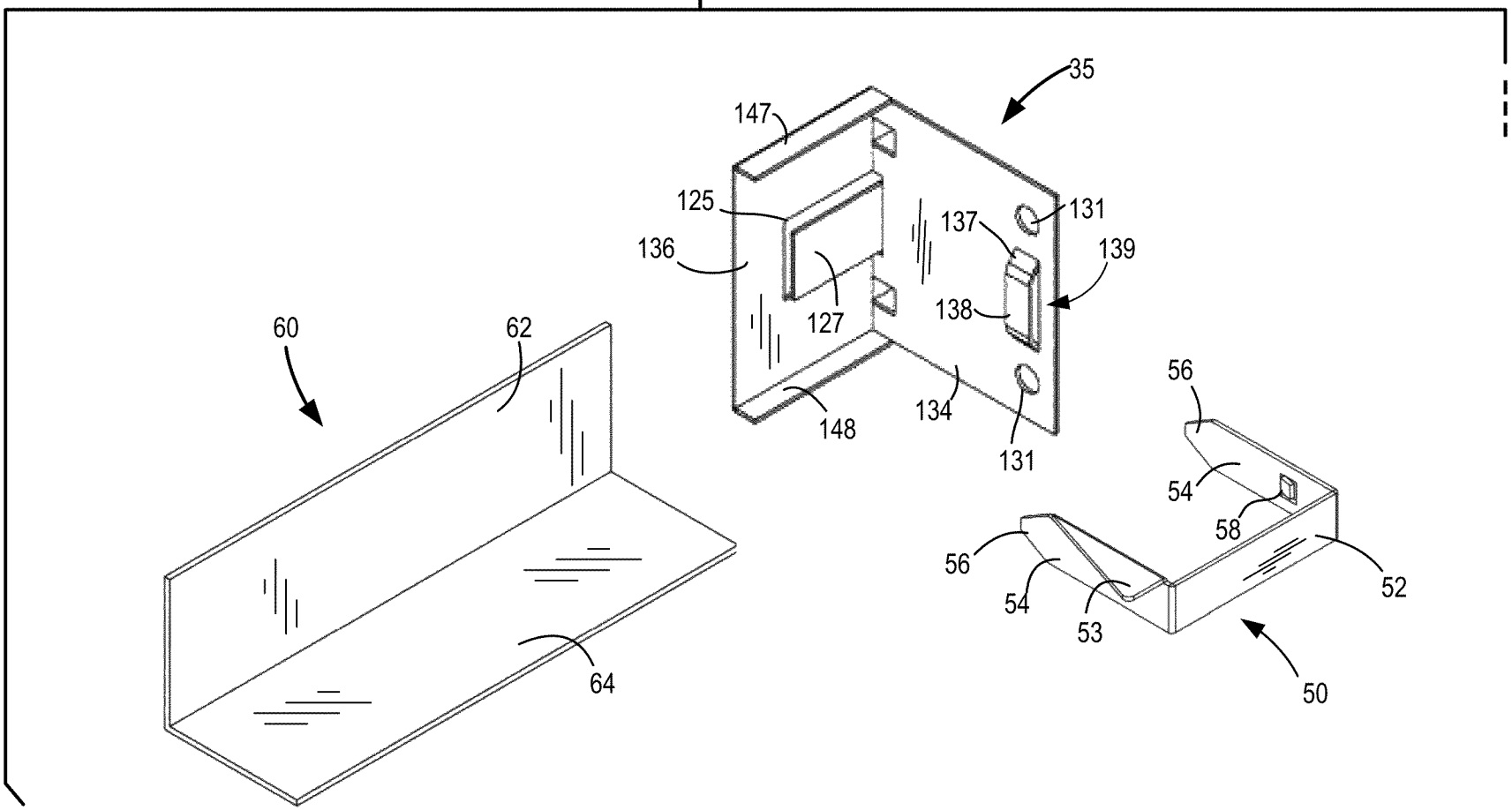
FIG. 18 is a drawing which is useful for understanding the how the L-bracket in FIGS. 15-17 can be used in an alternative orientation.

The flange 136 may have an additional flange 148 extending outwardly from a top portion of flange 136. The additional flange 148 extends from the face of the flange in a direction perpendicular to the side plate 134 and the flange 136. The additional flange 148 serves a purpose similar to flange 147 when the bracket is attached to an opposite side of a mullion, in the orientation shown in FIG. 18. In other words, the flange 148 can serve as a support for the stiffener 60 when the bracket 35 is in the orientation shown in FIG. 18. The configuration of the bracket 35 is such that an end portion 63 of vertical face plate 62 of stiffener 60 may similarly be received into receiving slot 125 when the bracket has the orientation shown in FIG. 18.

In the solution described with respect to FIGS. 15-18 the bracket 35, clip 50, and stiffener 60 can be made of steel or other metal. Bracket 35 may also be made of a suitably rigid polymer or composite material. Other materials may be used as appreciated by one of ordinary skill in the art.

Brackets and clips similar to those described herein can facilitate new and advantageous ways of assembling building curtain walls. As explained with reference to FIG. 2, main spandrel insulation 22 is positioned within a spandrel area 14. Conventional construction techniques usually involve installing the thermal insulation 22 in the spandrel area of the curtain wall after the various mullions and transoms have been attached to one or more slabs 12 which form the floors of a multi-floor building. The process usually involves a series of steps which begin with attaching the mullions and transoms to the slab to form the support structure for the curtain wall. To these mullions and transoms vision glass and spandrels panels are attached to form the exterior façade of the building. The thermal insulation 22 is then installed behind the spandrel areas, and finally the safing insulation is positioned between the insulation panels 22 and each slab. Although this process can be effective, experience has shown that it is labor intensive and presents certain risks of injury to workers.

The brackets and clips disclosed herein can make the insulation installation process less labor intensive and reduce the risk of injury at the building worksite. However, a further advantage of certain clips and brackets described herein is that they facilitate prefabrication of curtain wall sections, away from the construction site, in a controlled factory environment. According to one aspect, efficient prefabrication is facilitated because the entire assembly process can be performed without having to rotate or reposition the mullion/transom frame as the fabrication process progresses. The details and advantages of this approach will become more apparent from the description below and the accompanying drawing figures.

Figure 19A:
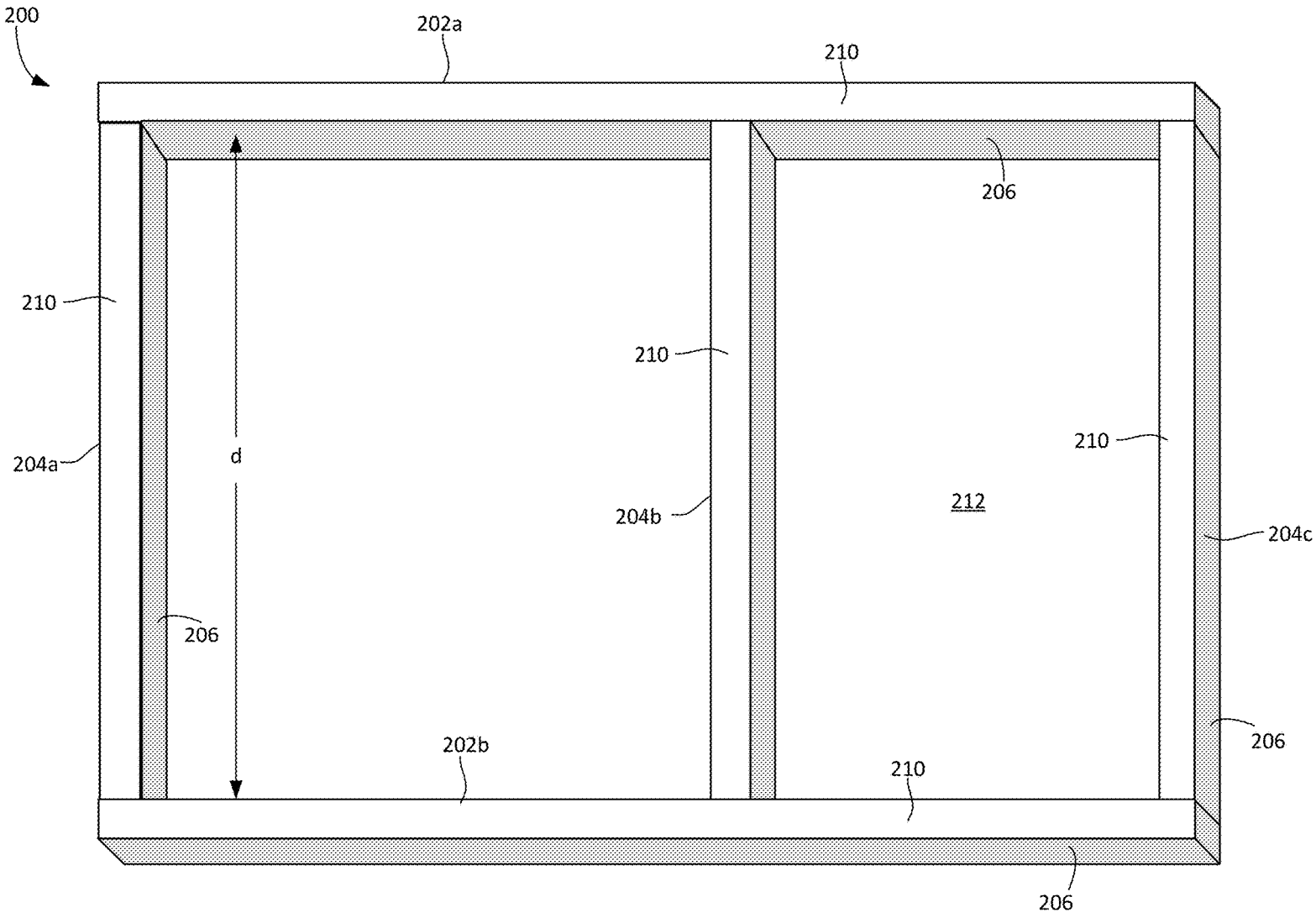
FIG. 19A is a top view of a frame for a curtain wall assembly (CWA).
Figure 19B:
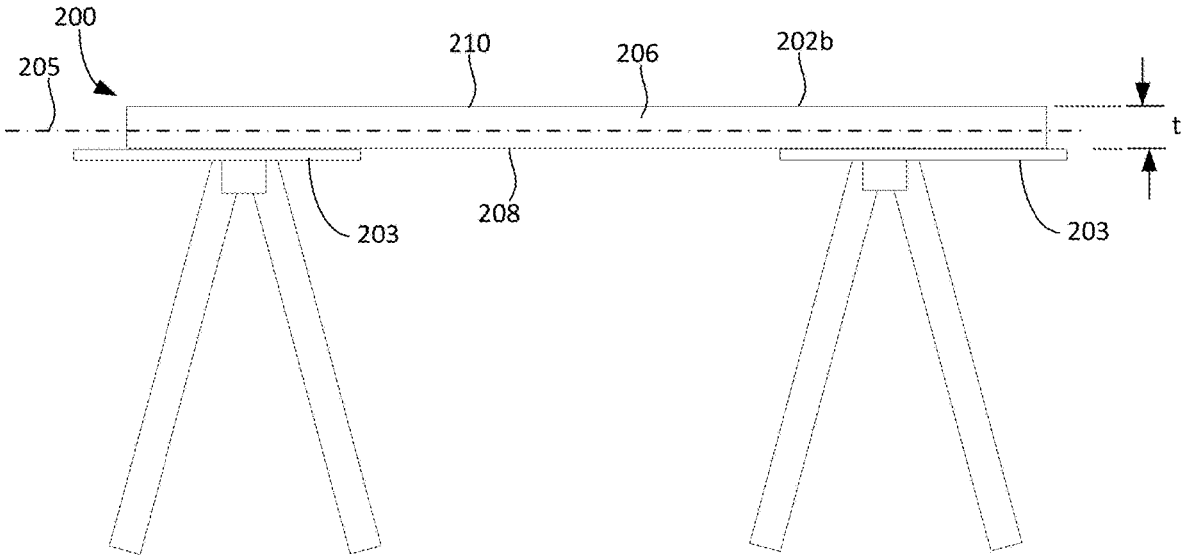
FIG. 19B is a side view of the frame in FIG. 19A.

Referring now to FIGS. 19A and 19B, a solution for prefabricating a curtain wall assembly (CWA) for a building can begin with the assembly of a frame 200. The frame 200 can include curtain wall curtain structural members including two or more mullions 202*a*, 202*b* and two or more transom members 204*a*, 204*b*, 204*c*. These structural members can be comprised of a rigid material such as steel or extruded aluminum.

In some implementations, the mullions 202*a*, 202*b* can be aligned in parallel and spaced apart a first predetermined distance d. According to one aspect, the mullions can be disposed on a jig or an assembly support structure 203 so that the mullions transoms are disposed in a common plane 205. Transoms 204*a*, 204*b*, 204*c* are positioned so that they extend orthogonal to the mullion members and span the predetermined distance d. For example, ends of the upper and lower transoms 204*a*, 204*c* can be respectively attached at opposing ends of the mullions 202*a*, 202*b*. In some implementations, a third transom 204*b* can be secured to the mullions at an intermediate location between the upper and lower transoms 204*a*, 204*c*. Brackets, mechanical fasteners, adhesive, or a combination thereof can be used to attach the mullions and the transoms. The mullions and transoms are securely attached at their adjoining ends so that the combination of elements forms a frame 200 defining a rigid rectangular construct. This frame 200 can have a frame thickness t defined by a frame wall 206. As shown in FIGS. 19A and 19B, the frame wall 206 extends orthogonal to the common plane from an interior frame edge 208 to an exterior frame edge 210.

Figure 20:
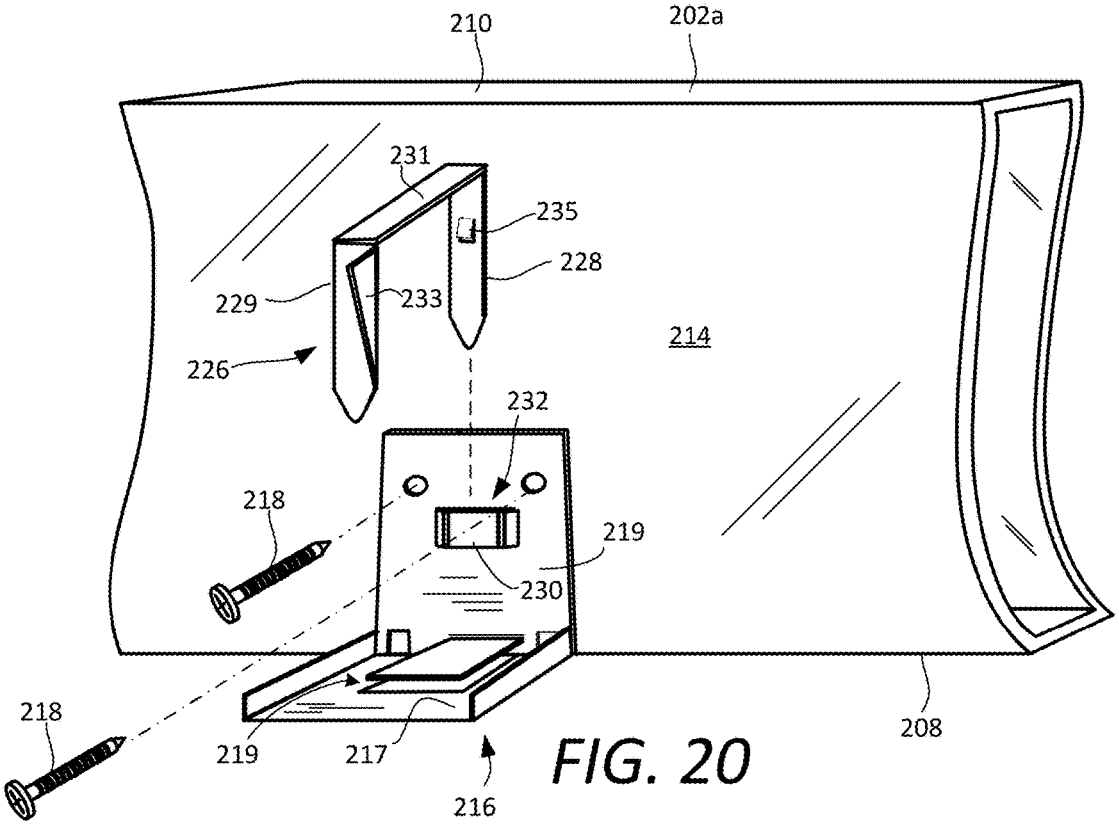
FIG. 20 is a detailed view of portion of a mullion showing the installation of a bracket, and an associated clip.
Figure 21:
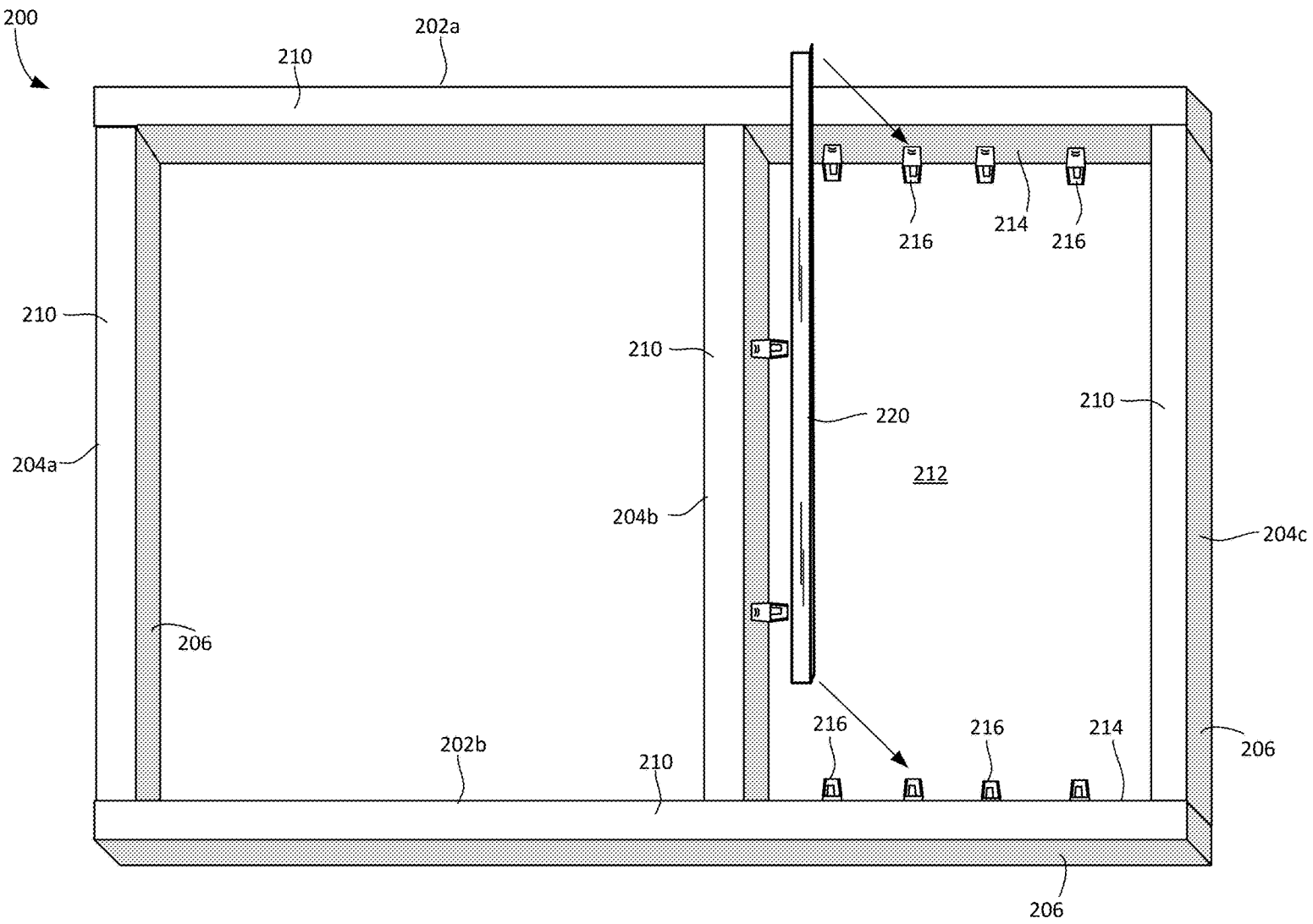
FIG. 21 is a top view of a frame for a CWA, and is useful for understanding how a stiffener and a plurality of brackets are installed.

The frame is prepared for receiving insulation in a spandrel area 212. The spandrel area is an area extending between the pair of mullions 202*a*, 202*b*. In some implementations, the spandrel area may be further defined by one or more transoms 204*b*, 204*c* which extend between the mullions 202*a*, 202*b*. Referring now to FIGS. 20-21, the frame is prepared for receiving the spandrel area insulation by mounting one or more brackets 216 along the interior frame edge 208. These brackets are disposed at spaced apart locations on opposing inner faces 214 of the frame wall defined by the pair of mullion members. In some scenarios, the brackets 216 can also be installed along the interior frame edge 208 at spaced apart locations on opposing inner faces of the frame wall defined by transom members. The brackets 216 can be secured to the mullions and/or transom using an attachment mechanism. Examples of suitable attachment mechanisms can include one or more mechanical fasteners, an adhesive, and/or welding. FIG. 20 shows a scenario in which the mechanical fastener is a screw 218. In some implementations, it can be convenient to secure these brackets 216 to the mullions and/or spandrels before the frame is assembled. Alternatively, these brackets can be secured to the mullions and/or spandrels after the frame 200 has been assembled.

The brackets can be comprised of a flange plate 217 and a side plate 219. The flange plate 217 can define a first major side of the bracket 216 and the side plate 219 can define a second major side of the bracket. As best understood with reference to FIG. 20, the flange plate 217 can extend transverse to the side plate 219. In the scenario shown in FIG. 20, the flange plate and the side plate are orthogonal to define an L-bracket. With the side plates 219 each secured to the opposing inner faces 214 of the frame wall, the flange plates 217 of each bracket will extend into the spandrel area 212 in a direction orthogonal to the opposing inner faces 214. According to one aspect, the brackets 216 can be similar to L-brackets 35. However, the solution is not limited in this regard and in other scenarios, the brackets 216 can have a configuration similar to bracket 30 or 30'. Of course, other bracket configurations are also possible and the exact configuration of the bracket is not critical to the solution presented herein.

Figure 22:
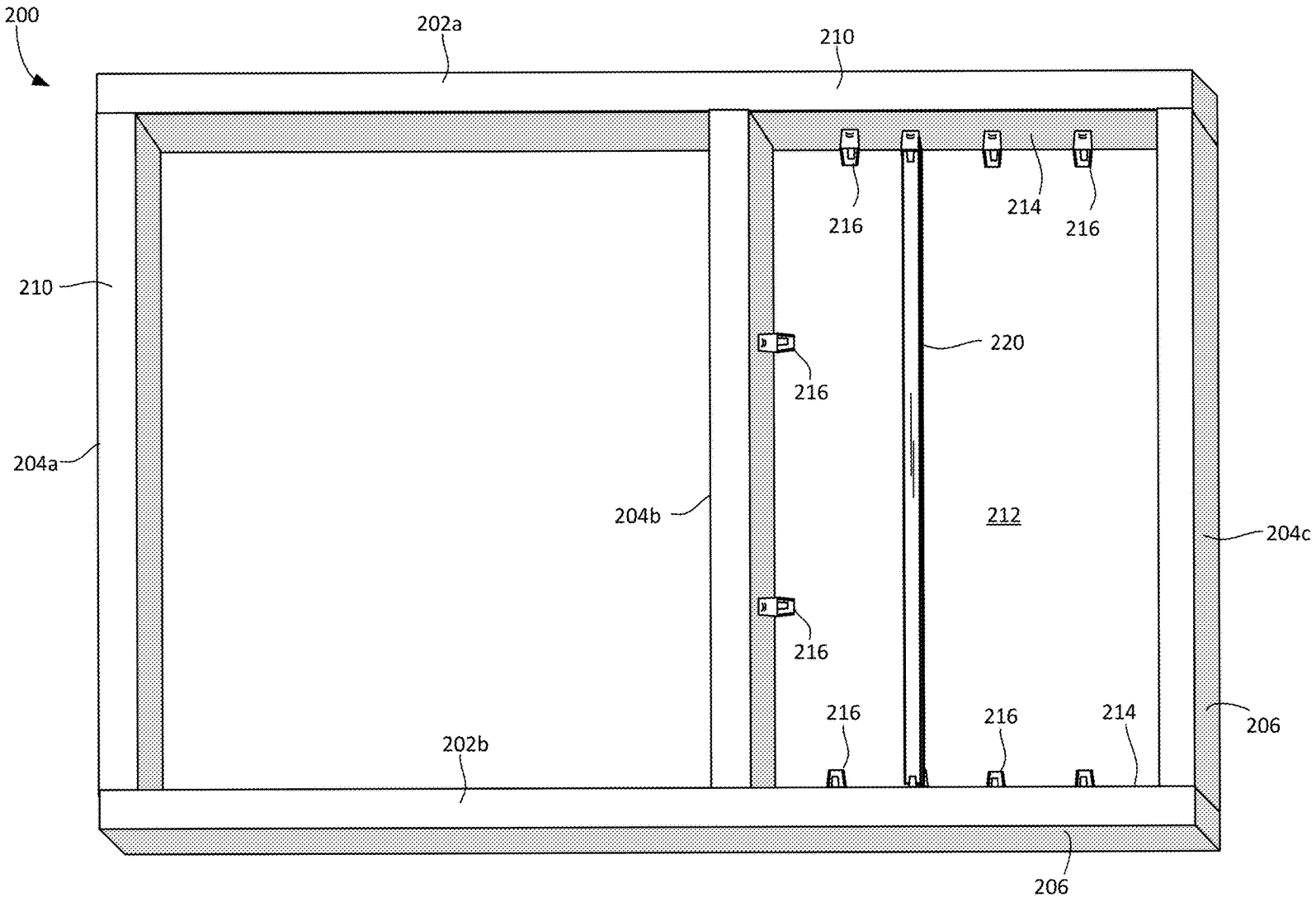
FIG. 22 is a top view of the frame which is useful for understanding an arrangement with a fully installed stiffener.

In some scenarios, the preparation of the frame for receiving insulation can also involve installing a stiffener 220. Installation of a stiffener 220 is illustrated in FIGS. 21-22. Stiffener 220 can be similar to stiffener 60 described herein. As such, the stiffener 220 can be comprised of a mechanical backer bar, such as a rigid metal angle iron or hat channel bar. The stiffener 220 can be received in a slot 219 formed in the flange plate 217 of a pair of opposing brackets 216. In some implementations, the engagement of the stiffener 220 with the brackets 216 can be similar to the engagement of the stiffener 60 with the bracket shown in FIG. 17. The stiffener 220 will serve a purpose similar to stiffener 60 in preventing a spandrel insulation panel from deforming due to the forces exerted by compressed safing insulation.

Figure 23:
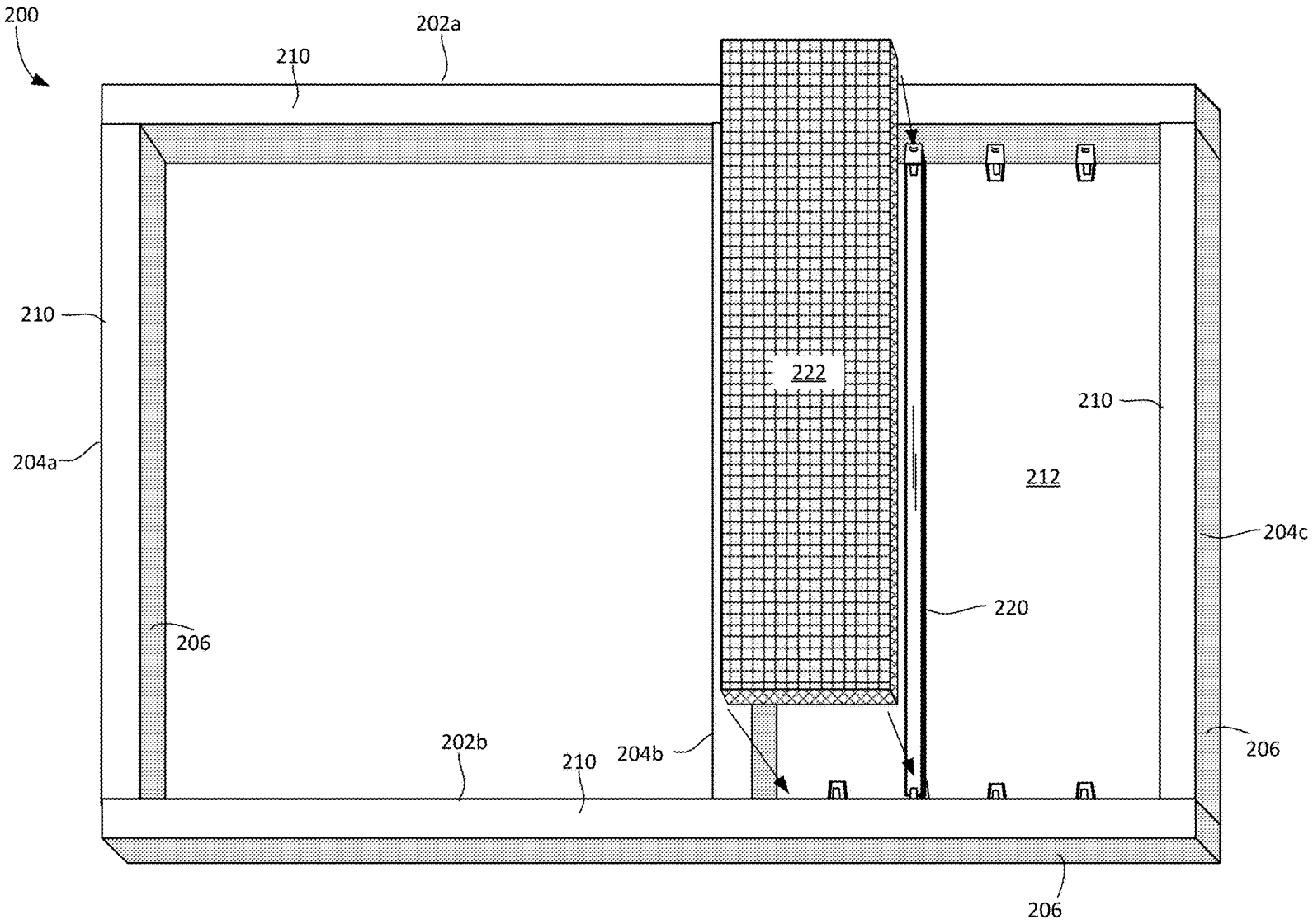
FIG. 23 is a top view of the frame that is useful for understanding how a thermal insulation panel can be installed in a spandrel area, and supported by the stiffener.
Figure 24:
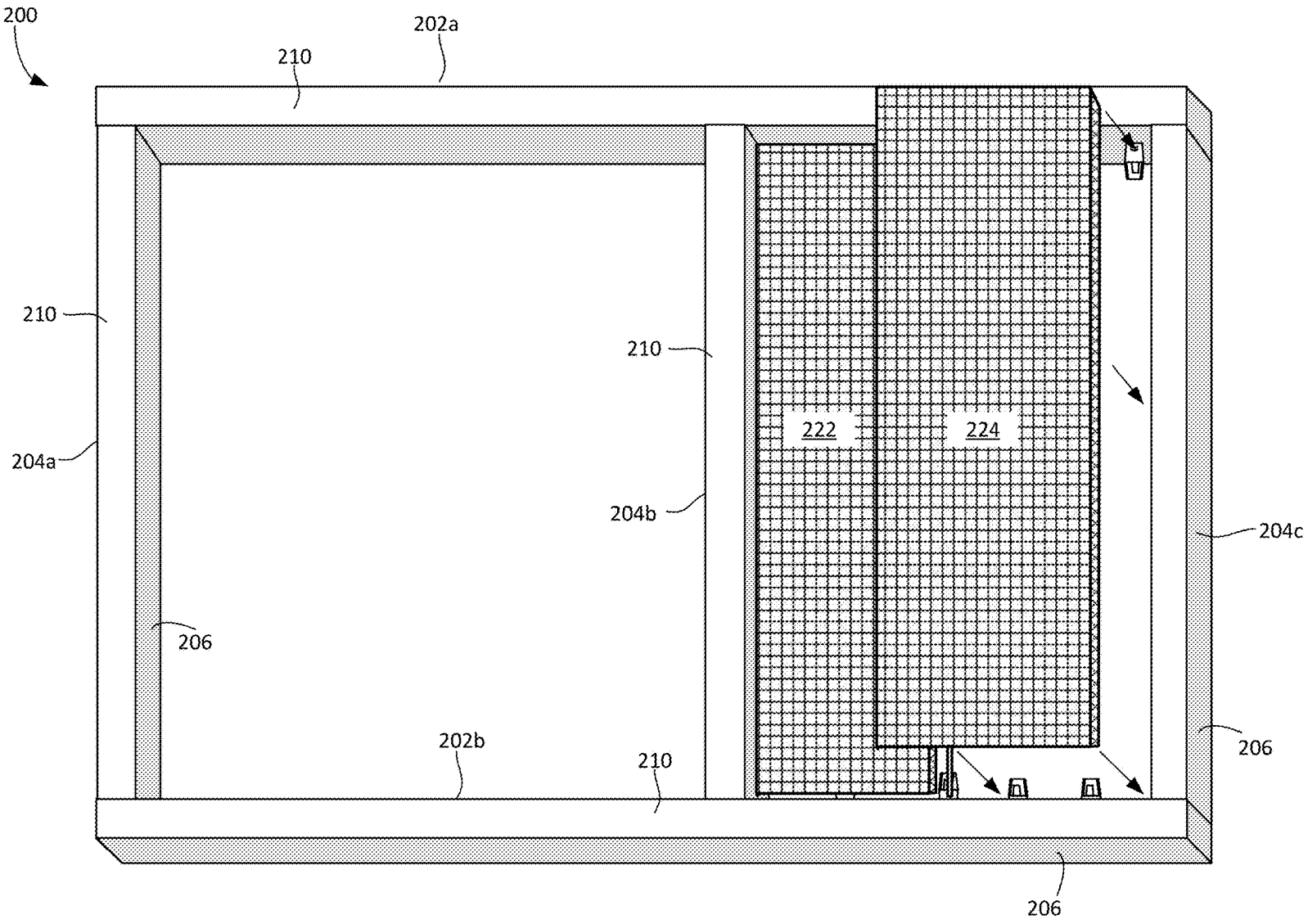
FIG. 24 is a top view of the frame that is useful for understanding how a second thermal insulation panel can be installed in the spandrel area.
Figure 25:
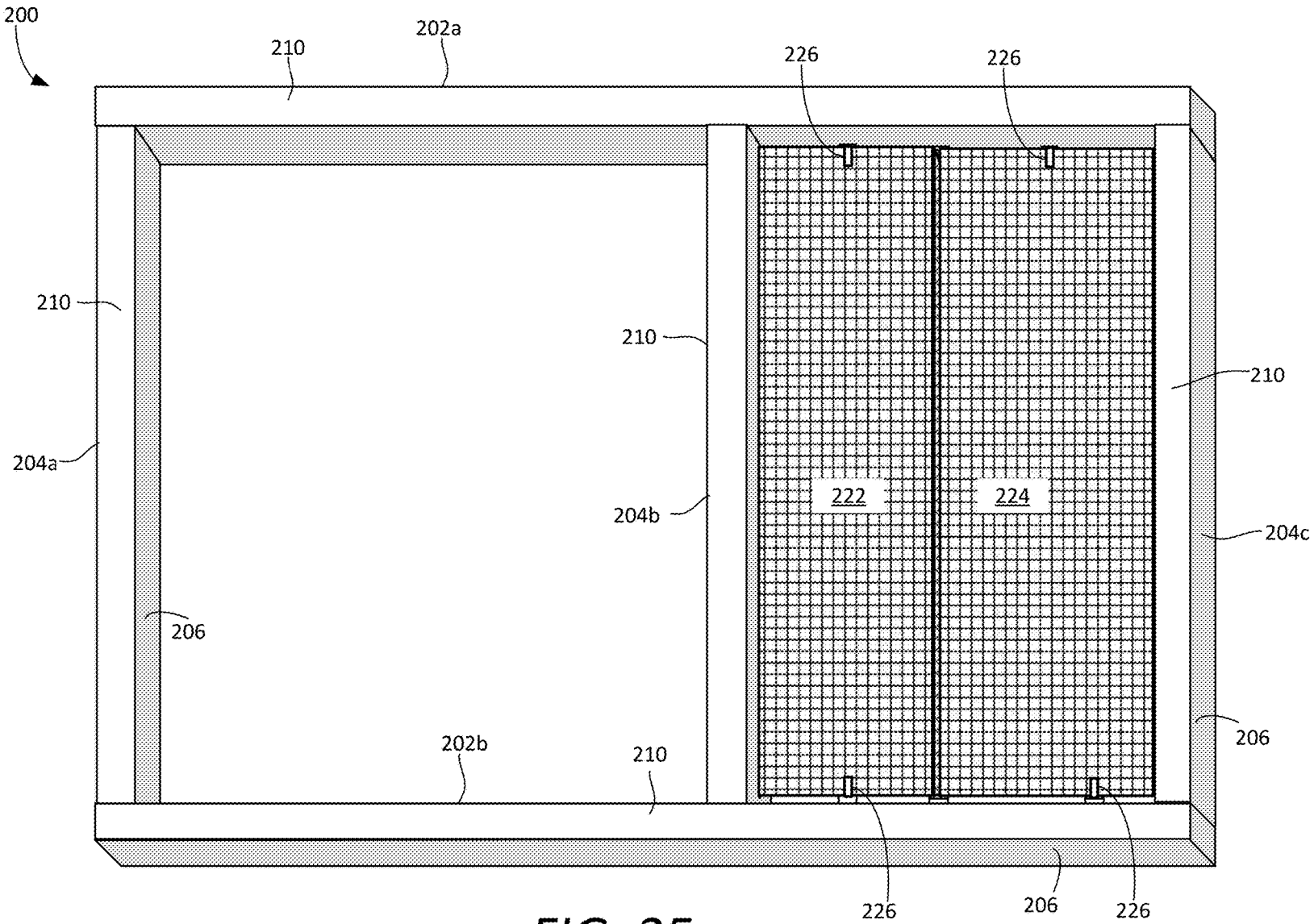
FIG. 25 is a top view of the frame that is useful for understanding how the thermal insulation panels can be secured to the frame using a plurality of clips.

After the frame 200 has been prepared as described, one or more thermal insulation panels 222 can be installed in the spandrel area 212. This installation is best understood with reference to FIGS. 23-25. As shown in FIGS. 23 and 24, thermal insulation panel 222 can be positioned in the spandrel area 212 so that it is supported on the flange plate 224 of each brackets 216. If a stiffener 220 is used, then an edge of the thermal insulation panel 220 can also be supported on the stiffener 220. A second thermal insulation panel 224 can similarly be installed in the spandrel area 212 as shown in FIGS. 24-25.

Once positioned in this way, the one or more thermal insulation panels in the spandrel area 212 can be engaged using one or more clips 226. As best understood with reference to FIG. 20, each of the clips 226 can be retained to the frame 200 by inserting a first clip leg 228 of each clip in a receiver aperture formed by a portion of the bracket 216. In some scenarios, this receiver aperture can be a slot 232 provided on a side plate 219 of each bracket 216. The one or more thermal insulation panels 222, 224 can be engaged using a second clip leg 229. This second clip leg 229 can be attached to the first clip leg by a bridge member 231 from which the first and second clip legs extend to define a U-shaped structure. According to one aspect, the bracket 216 can be similar to the bracket 35 and the clip 226 can be similar to the clip 50 described herein. As such, the receiver aperture can be a slot 232 which is at least partially formed from a portion of a slot plate 230. The slot plate 230 can be cut and raised from a portion of the side plate 219 to define the slot 232.

In some implementations, the first clip leg can be retained in the receiver aperture or slot once the clip leg has been inserted therein. For example, this can be facilitated by using a projection 235 formed on the first clip leg to engage the slot plate. Similarly, the clip 226 can include a wedged wing 233 to help retain the insulation in place within the frame. Of course, the solution is not limited to the bracket and clip configuration shown in the figures. Other styles of brackets and clips can also be devised to facilitate a similar result. Accordingly, any suitable combination of bracket and clip, whether now known or known in the future, can be used for the purposes described herein.

Figure 26:
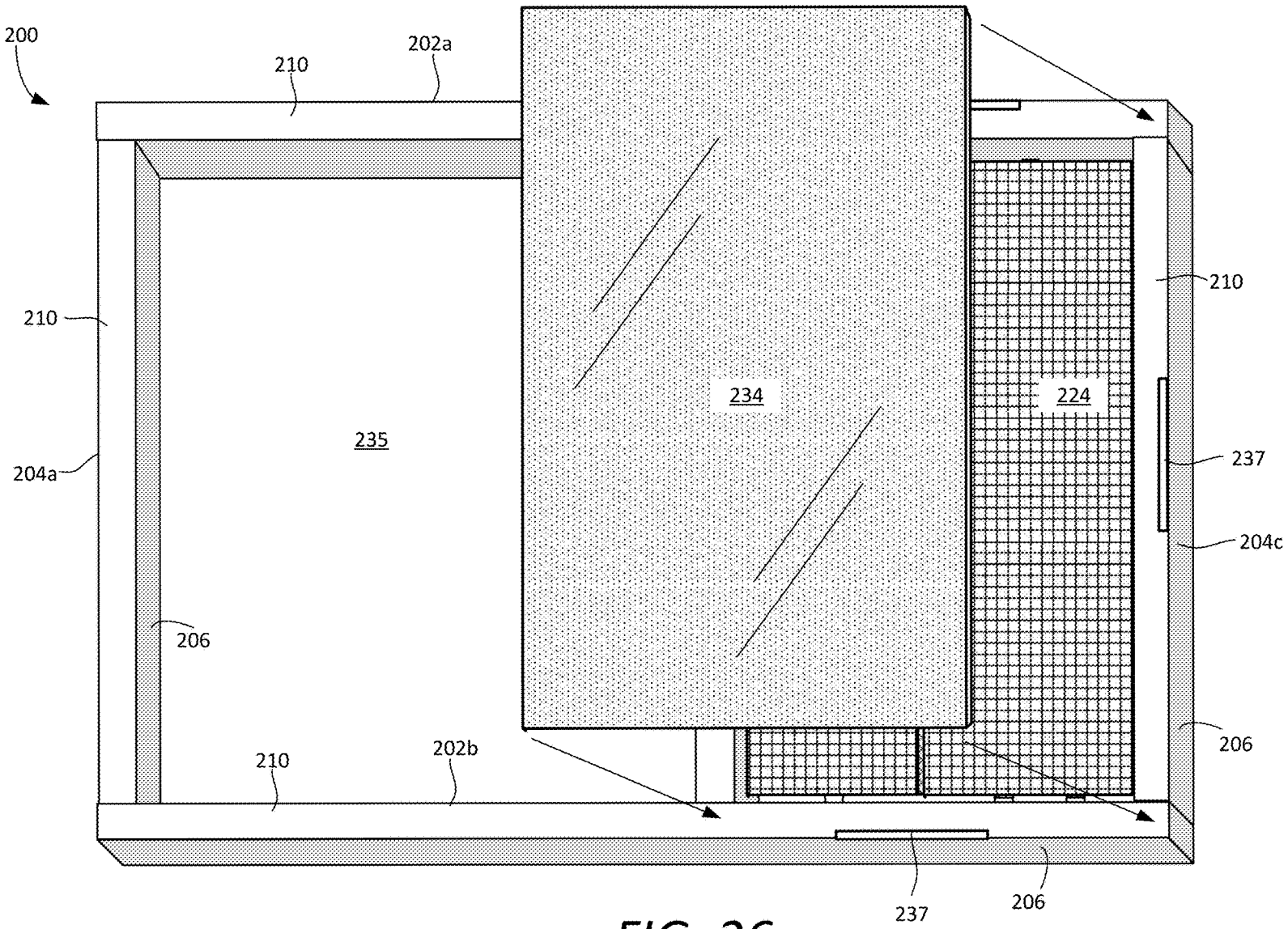
FIG. 26 is a drawing that is useful for understanding how an exterior spandrel panel can be installed on the frame.
Figure 27:
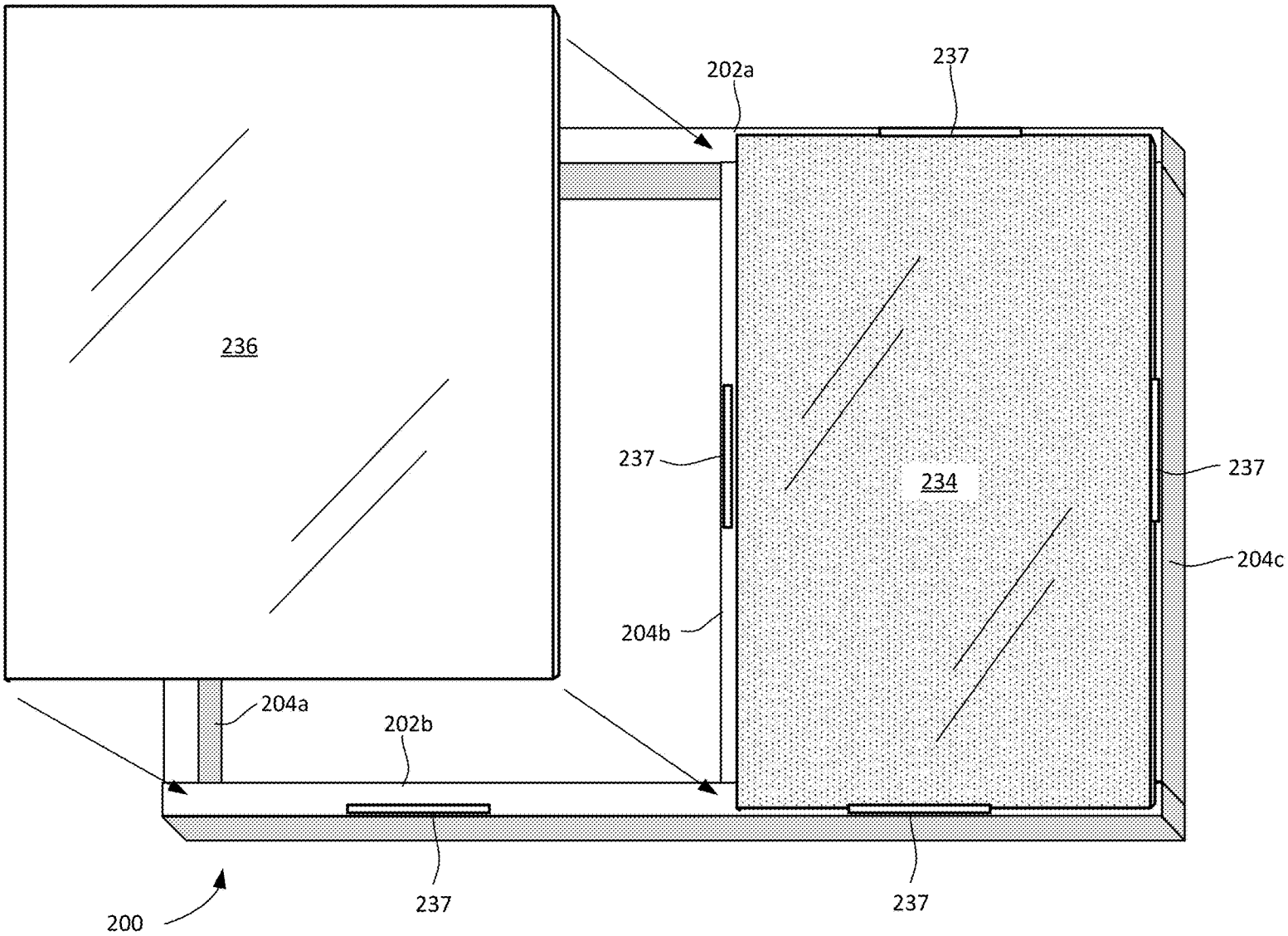
FIG. 27 is a drawing that is useful for understanding how an vision glass panel can be installed on the frame.
Figure 28:
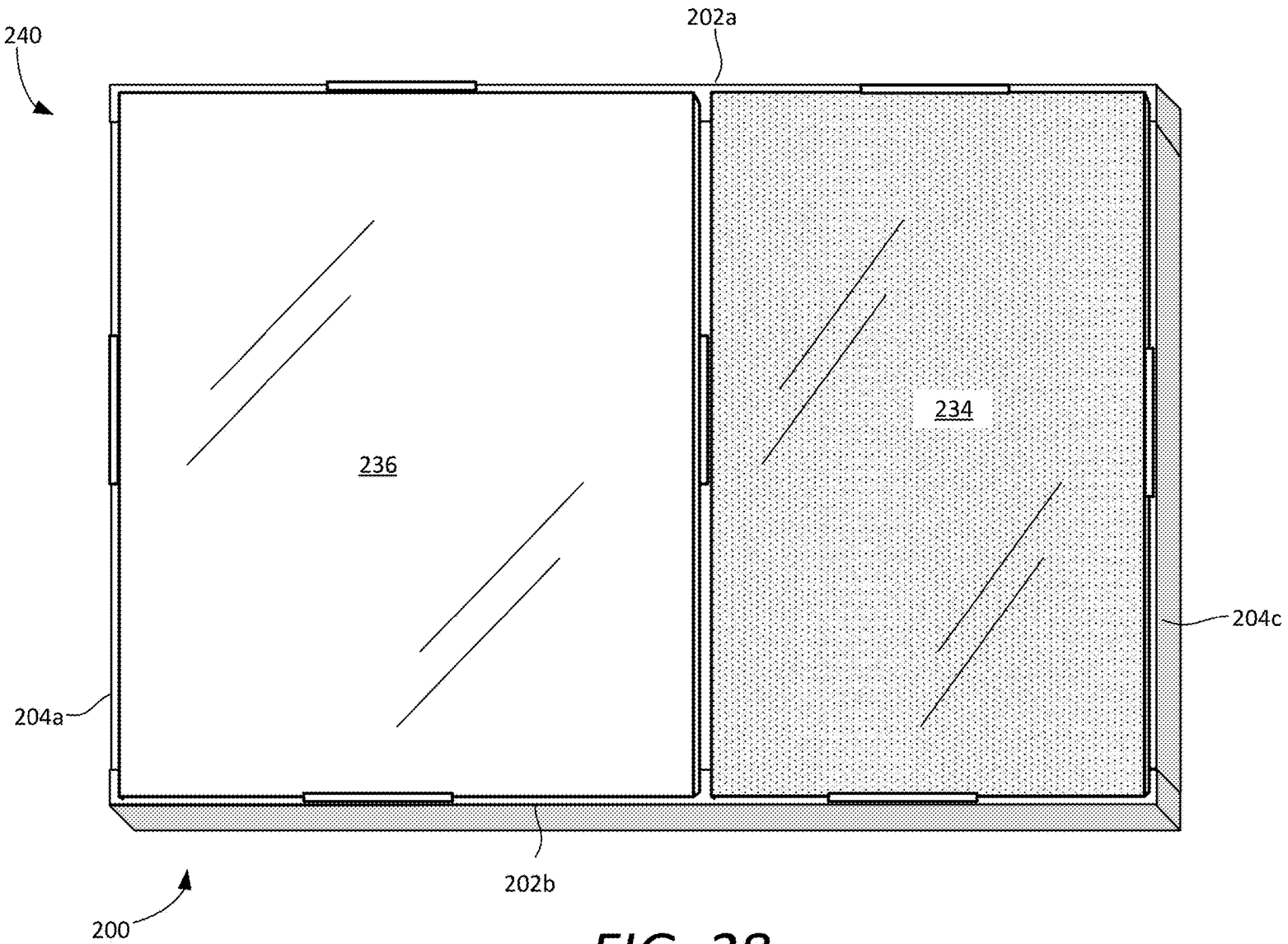
FIG. 28 is a drawing that is useful for understanding a completed CWA that is ready for attachment to a floor slab of a building under construction.

Once the insulation panels are secured, one or more exterior panels are mounted to the exterior frame edge 210 opposed from the thermal insulation panel or panels. This step is illustrated in FIGS. 26-28. The exterior panel or panels will define a part of an exterior facade of a building. In some scenarios, the one or more exterior panels will include a spandrel panel 234 which exclusively covers the spandrel area 212. The spandrel panel can be comprised of a material such as metal, glass, stone, or other material that is intended to withstand exposure to the environment.

If a spandrel panel 234 is used, a second exterior panel can be secured to the exterior frame edge 210. For example, this second exterior panel can be a vision glass panel 236 comprised of glass. The vision glass panel can be sized and shaped to cover a vision glass area 235 defined by mullions 202*a*, 202*b* and transoms 204*a*, 204*b*. In other scenarios, the spandrel panel 234 and the vision glass panel 236 can both be replaced by a single exterior panel (not shown) that extends from transom 204*a* to transom 204*c*. In other words, the single exterior panel can have a length and width sufficient to extend over the spandrel area and a vision glass area defined by the frame 200.

The one or more exterior panels 234, 236 can be secured to the frame 200 with one or more mechanical fasteners 237. The mechanical fasteners 237 can comprise one or more of brackets, screws, latches and so on. In some scenarios, an adhesive can be used to further secure the exterior panels to the frame 200. The exact attachment method is not critical provided that a secure weather-tight seal is established between the frame 200 and the one or more exterior panels. After the exterior panels have been mounted to the frame in this way, the completed curtain wall assembly (CWA) 240 is ready to be installed as part of building which is under construction.

Figure 29:
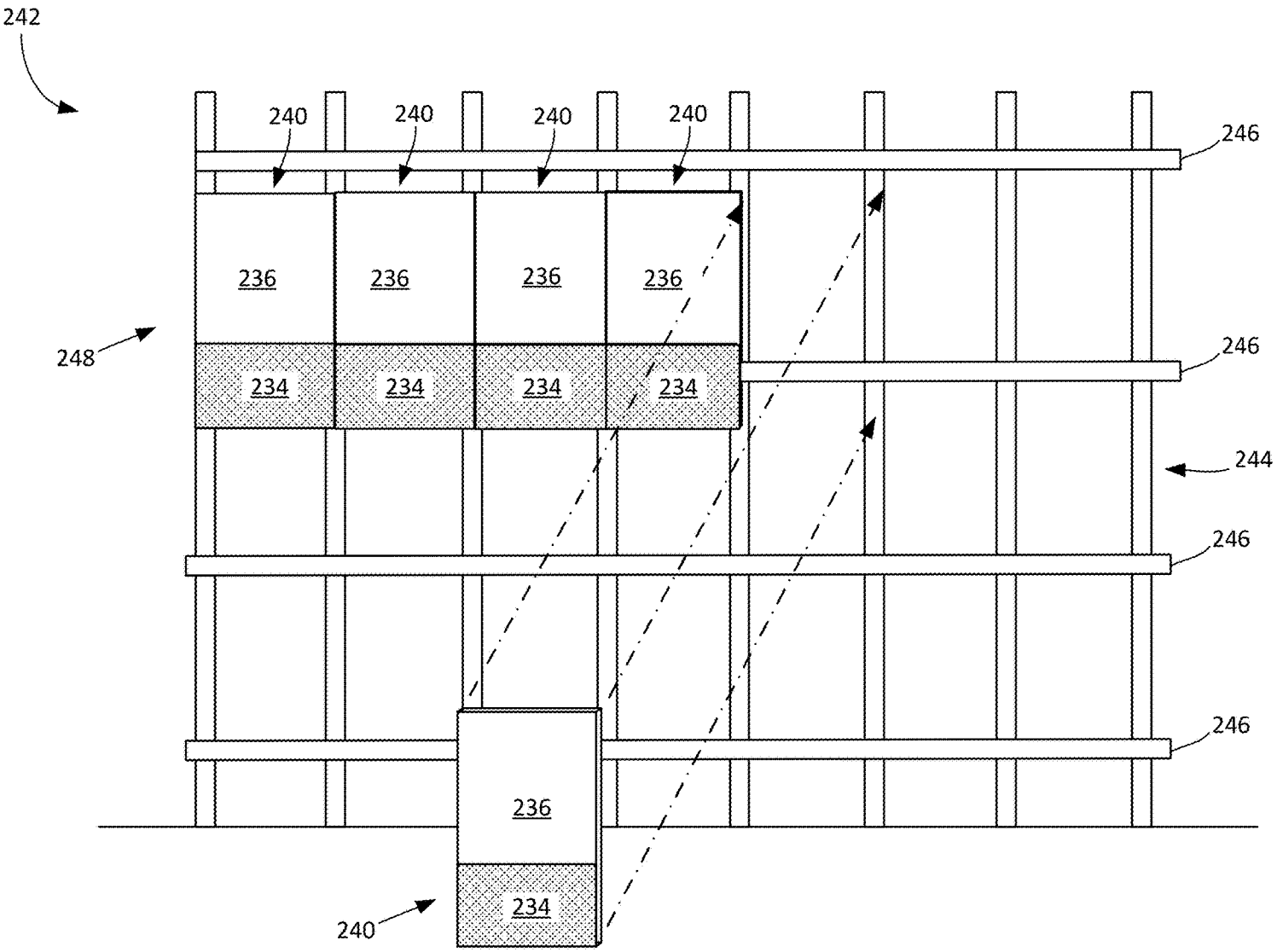
FIG. 29 is a drawing that is useful for understanding how a plurality of prefabricated CWA can be secured to a building floor slab to form a curtain wall.

Referring now to FIG. 29, a multi-story building 242 that is under construction can comprise a structural framework 244 which supports a plurality of concrete floor slabs 246. An external wall structure or curtain wall 248 is secured to the floor slabs 246. In a solution described herein, the curtain wall 248 is comprised of a plurality of pre-assembled CWA 240 which are attached to the floor slabs. This is in contrast to the conventional method of assembling the CWA 240 (including the thermal insulation panels) on site after the mullions and transoms have been secured to the floor slabs.

In contrast to such conventional methods, the prefabricated CWA 240 is manufactured off-site using the techniques and methods described herein. A plurality of the prefabricated CWA 240 can then be transported to the building site where each CWA 240 is secured to the floor slab as a preassembled unit to facilitate construction of the curtain wall 248. This process avoids the necessity of a time consuming and sometimes injury prone process of assembling the curtain wall directly on the building. It also avoids the need for installing the installation panels after the mullions and transoms have been secured to the building. The features and functions described above, as well as alternatives, may be combined into many other different systems or applications as appreciated by one ordinarily skilled in the art. Accordingly, it will be recognized by those skilled in the art that changes or modifications may be made to the above-described embodiments without departing from the broad inventive concepts of the invention. It should, therefore, be understood that this invention is not limited to the particular embodiments described herein, but is intended to include all changes and modifications that are within the scope and spirit of the invention as defined in the claims.

We claim:

1. A method for prefabricating a curtain wall assembly (CWA) for a building, comprising:

assembling a frame by aligning in parallel a pair of mullion members which are spaced apart a first predetermined distance in a common plane, and securing to the mullion members a plurality of transom members which extend orthogonal to the mullion members and span the predetermined distance to form a rigid rectangular construct having a frame thickness defined by a frame wall which extends orthogonal to the common plane from an interior frame edge to an exterior frame edge;

preparing the frame for receiving insulation in a spandrel area extending between the pair of mullions by mounting one or more brackets along the interior frame edge at spaced apart locations on opposing inner faces of the frame wall defined by the pair of mullion members;

supporting a thermal insulation panel in the spandrel area using a flange plate of each bracket, the flange plate defining a first major side of each bracket which extends into the spandrel area from the opposing inner faces;

engaging the thermal insulation panel in the spandrel area using one or more clips; and retaining each of the one or more clips to the frame by inserting a first clip leg of each clip in a receiver aperture which is provided on a side plate of each bracket, the side plate defining a second major side of the bracket extending transverse to the first side.

2. The method of claim 1, further comprising securing to the exterior frame edge opposed from the thermal insulation panel at least one exterior panel that defines a part of an exterior facade of the building.

3. The method of claim 2, further comprising positioning the CWA which has been prefabricated on the building to form a portion of the building curtain wall after the thermal insulation panel and the at least one exterior panel have been installed.

4. The method of claim 2, wherein the exterior panel is a spandrel panel which exclusively covers the spandrel area and the method further comprises positioning on the exterior frame edge a second exterior panel that is a vision glass panel.

5. The method of claim 2, further comprising selecting a material of the at least one exterior panel to be glass.

6. The method of claim 5, further comprising selecting the at least one exterior panel to have a length and width sufficient to extend over the spandrel area and a vision glass area of the CWA.

7. The method of claim 1, further comprising supporting the thermal insulation panel using a stiffener which extends between opposing ones of the brackets which are disposed on the mullion members.

8. The method of claim 7, further comprising securing the stiffener in the frame using a slot defined by a slot plate that is cut and raised from a portion of the flange plate of each of the brackets.

9. The method of claim 1, further comprising engaging the thermal insulation panel using a second clip leg that is attached to the first clip leg by a bridge member from which the first and second clip legs extend.

10. The method of claim 9, further comprising facilitating retention of the thermal insulation panel in the spandrel area by using a wing that is formed on a tapered free end of the second clip leg and wedged towards the tapered free end.

11. The method of claim 1, further comprising forming the receiver aperture from a portion of the side plate which is cut and raised from a surface of the side plate to define as a slot.

12. The method of claim 1, further comprising selecting each of the one or more brackets to comprise an L-shaped bracket comprised of the side plate and the flange plate.

13. The method of claim 1, further comprising retaining the first clip leg in the receiver aperture once the clip leg has been inserted therein.

14. The method of claim 13, further comprising facilitating the retaining by using a projection formed on the first clip leg to engage a slot plate which at least partially defines the receiver aperture.

15. A method for assembling a multi-story building using a prefabricating a curtain wall assembly (CWA), comprising:

assembling a frame by aligning in parallel a pair of mullion members which are spaced apart a first predetermined distance in a common plane, and securing to the mullion members a plurality of transom members which extend orthogonal to the mullion members and span the predetermined distance to form a rigid rectangular construct having a frame thickness defined by a frame wall which extends orthogonal to the common plane from an interior frame edge to an exterior frame edge;

preparing the frame for receiving insulation in a spandrel area extending between the pair of mullions by mounting one or more brackets along the interior frame edge at spaced apart locations on opposing inner faces of the frame wall defined by the pair of mullion members;

supporting a thermal insulation panel in the spandrel area using a flange plate of each bracket, the flange plate defining a first major side of each bracket which extends into the spandrel area from the opposing inner faces;

engaging the thermal insulation panel in the spandrel area using one or more clips; and retaining each of the one or more clips to the frame by inserting a first clip leg of each clip in a receiver aperture which is provided on a side plate of each bracket, the side plate defining a second major side of the bracket extending transverse to the first side; and securing the CWA which has been prefabricated to a floor slab on the building to form a portion of the building curtain wall after the thermal insulation panel has been installed.

16. The method of claim 15, further comprising attaching to the exterior frame edge opposed from the thermal insulation panel at least one exterior panel that defines a part of an exterior facade of the building.

17. The method of claim 16, further comprising attaching the at least one exterior panel prior to securing the CWA to the floor slab.

18. The method of claim 16, wherein the at least one exterior panel is a spandrel panel which exclusively covers the spandrel area and the method further comprises positioning on the exterior frame edge a second exterior panel that is a vision glass panel.

19. The method of claim 18, further comprising selecting the at least one exterior panel to have a length and width sufficient to extend over the spandrel area and a vision glass area of the CWA.

20. The method of claim 15, further comprising supporting the thermal insulation panel using a stiffener which extends between opposing ones of the brackets which are disposed on the mullion members.

* * * * *